US007312561B2

(12) United States Patent
Moriguchi et al.

(10) Patent No.: US 7,312,561 B2
(45) Date of Patent: Dec. 25, 2007

(54) ELECTRON-EMITTING DEVICE, ELECTRON SOURCE, AND METHOD FOR MANUFACTURING IMAGE DISPLAYING APPARATUS

(75) Inventors: Takuto Moriguchi, Kanagawa-ken (JP); Toshihiko Takeda, Kanagawa-ken (JP); Keisuke Yamamoto, Kanagawa-ken (JP); Tamaki Kobayashi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 474 days.

(21) Appl. No.: 11/106,584

(22) Filed: Apr. 15, 2005

(65) Prior Publication Data

US 2005/0236952 A1 Oct. 27, 2005

(30) Foreign Application Priority Data

Apr. 21, 2004 (JP) ..... 2004-125255

(51) Int. Cl.
*H01J 9/02* (2006.01)
*H01J 1/00* (2006.01)

(52) U.S. Cl. ..... 313/310; 313/311; 313/495

(58) Field of Classification Search ..... 313/310, 313/311, 495
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,448,132 | A * | 9/1995 | Komatsu | 313/495 |
| 5,532,544 | A | 7/1996 | Yoshioka et al. | 313/310 |
| 5,605,483 | A | 2/1997 | Takeda et al. | 445/2 |
| 5,661,362 | A | 8/1997 | Yoshioka et al. | 313/309 |
| 5,749,763 | A | 5/1998 | Yoshioka et al. | 445/51 |
| 5,759,080 | A | 6/1998 | Yoshioka et al. | 445/51 |
| 5,786,658 | A | 7/1998 | Tsukamoto et al. | 313/309 |
| 5,872,541 | A | 2/1999 | Yoshioka et al. | 345/74 |
| 6,184,610 | B1 * | 2/2001 | Shibata et al. | 313/309 |
| 6,225,749 | B1 | 5/2001 | Kobayashi et al. | 315/169.3 |
| 6,267,636 | B1 | 7/2001 | Onishi et al. | 446/6 |
| 6,313,815 | B1 | 11/2001 | Takeda et al. | 345/75.2 |
| 6,348,761 | B1 | 2/2002 | Nomura et al. | 313/495 |
| 6,379,211 | B2 | 4/2002 | Onishi et al. | 445/73 |
| 6,459,207 | B1 | 10/2002 | Nomura et al. | 315/169.3 |
| 6,473,063 | B1 | 10/2002 | Suzuki et al. | 345/74.1 |
| 6,515,640 | B2 | 2/2003 | Okunuki et al. | 345/75.2 |
| 6,555,957 | B1 | 4/2003 | Nomura et al. | 313/495 |
| 6,633,118 | B1 | 10/2003 | Yamamoto et al. | 313/495 |

(Continued)

FOREIGN PATENT DOCUMENTS

JP 2002-231872 8/2000

*Primary Examiner*—Nimeshkumar D. Patel
*Assistant Examiner*—Peter Macchiarolo
(74) *Attorney, Agent, or Firm*—Fitzpatrick, Cella, Harper & Scinto

(57) ABSTRACT

An electron-emitting device is equipped with a pair of first electroconductive members arranged on a substrate with an interval between them, wherein the interval becomes narrower at an upper position distant from a surface of the substrate than at a position on the surface, and a peak of one of the pair of the first electroconductive members is higher than a peak of the other of the pair of the first electroconductive members, and further an electron scattering surface forming film including an element having an atomic number larger than those of elements constituting the first electroconductive members as a principal component is provided on a surface of the one of the first electroconductive members.

14 Claims, 15 Drawing Sheets

U.S. PATENT DOCUMENTS

| | | | | |
|---|---|---|---|---|
| 6,642,649 | B1 | 11/2003 | Yamamoto et al. | 313/495 |
| 6,726,520 | B2 | 4/2004 | Takeda et al. | 445/62 |
| 6,731,060 | B1 | 5/2004 | Yamamoto et al. | 313/495 |
| 6,760,002 | B2 | 7/2004 | Suzuki et al. | 345/74.1 |
| 6,802,753 | B1 | 10/2004 | Ando et al. | 445/6 |
| 6,849,999 | B1 | 2/2005 | Kobayashi et al. | 313/495 |
| 6,896,571 | B2 | 5/2005 | Mizuno et al. | 445/24 |
| 2002/0068496 | A1 | 6/2002 | Onishi et al. | 445/6 |
| 2002/0096986 | A1* | 7/2002 | Motoi et al. | 313/310 |
| 2005/0052108 | A1* | 3/2005 | Motoi et al. | 313/310 |
| 2005/0164591 | A1 | 7/2005 | Mizuno et al. | 445/24 |
| 2005/0194912 | A1 | 9/2005 | Kobayashi et al. | 315/169.1 |
| 2005/0225230 | A1 | 10/2005 | Takeda et al. | 313/496 |
| 2005/0236952 | A1* | 10/2005 | Moriguchi et al. | 313/310 |
| 2005/0236962 | A1* | 10/2005 | Lee | 313/495 |
| 2005/0236965 | A1 | 10/2005 | Yamamoto et al. | 313/496 |
| 2005/0258734 | A1 | 11/2005 | Nukanobu et al. | 313/495 |
| 2005/0282458 | A1 | 12/2005 | Takeda et al. | 445/46 |
| 2006/0003660 | A1 | 1/2006 | Kobayashi et al. | 445/5 |

* cited by examiner

ELECTRON-EMITTING DEVICE, ELECTRON SOURCE, AND METHOD FOR MANUFACTURING IMAGE DISPLAYING APPARATUS

BACKGROUND OF THE INVENTION

1. Field of the Invention

The present invention relates to an electron-emitting device which emits a large amount of electrons and can obtain a stable emission current, an electron source using the electron-emitting device, and a method for manufacturing an image displaying apparatus.

2. Related Background Art

A surface conduction electron-emitting device has been conventionally known as an electron-emitting device for constituting a flat display. The basic configuration of the surface conduction electron-emitting device is one in which a pair of device electrodes and an electroconductive thin film connecting both the device electrodes to each other are formed on a substrate and an electron-emitting region is formed by performing an energization processing of the electroconductive thin film.

Japanese Patent Application Laid-Open No. 2000-231872 discloses a configuration in which a film including carbon or a carbon compound as the principal component thereof is deposited on an electroconductive thin film at the circumference of the electron-emitting region in the electron-emitting device having the basic configuration described above in order to improve the electron emission efficiency of the electron-emitting device.

In the case where the surface conduction electron-emitting device is applied to a practical use, for example, a flat panel image displaying apparatus or the like, a demand of suppressing the power consumption thereof while securing the display quality thereof arises. According to the demand, increasing the electron emission efficiency of the device, i.e. a ratio of a current accompanying an electron emission (emission current Ie) to a current flowing through the device (device current If), is requested. In particular, in case of displaying an image having a high image quality, many pixels are accordingly needed, and it is necessary to arrange many electron-emitting devices correspondingly to respective pixels. For this reason, not only the power consumption of the whole device becomes large, but also the ratio of the area which wiring occupies on a substrate becomes large, which serves as restrictions on the designing of an apparatus. If the electron emission efficiency of each electron-emitting device is raised and the power consumption thereof can be suppressed in this case, the width of a wire can be made to be small to result the expansion of the degree of freedom of designing.

Moreover, not only the improvement of the electron emission efficiency, but also the improvement of the emission current Ie itself are still requested for the purpose of obtaining a brighter image or the like.

Furthermore, it is important without saying that the characteristics of the electron-emitting device is kept in a good state for a long time on the occasion of a practical use, and the suppression of the deterioration of the characteristics is successively requested.

SUMMARY OF THE INVENTION

It is an object of the present invention to provide an electron-emitting device realizing a good electron emission characteristic and the elongation of its life simultaneously, and a method for manufacturing the same. Moreover, it is another object of the present invention to provide an electron source and an image displaying apparatus, both using a plurality of the electron-emitting devices, and a method for manufacturing them.

The present invention is an electron-emitting device equipped with a pair of first electroconductive members arranged on a substrate with an interval between them, wherein the interval becomes narrower at an upper position distant from a surface of the substrate than at a position on the surface, and a peak of one of the pair of the first electroconductive members is higher than a peak of the other of the pair of the first electroconductive members, and further an electron scattering surface forming film including an element having an atomic number larger than those of elements constituting the first electroconductive members as a principal component is provided on a surface of the one of the first electroconductive members.

Moreover, the present invention is an electron source wherein a plurality of the electron-emitting devices described above is arranged on the substrate.

Moreover, the present invention is an image displaying apparatus including an electron source equipped with a plurality of the electron-emitting devices described above is arranged on a substrate, and a phosphor member emitting light by irradiation of electrons emitted from the electron-emitting devices.

Moreover, the present invention is a method for manufacturing an electron-emitting device, including the steps of: forming a pair of first electroconductive members on a substrate with a first interval becoming narrower at an upper position distant from a surface of the substrate than at a position on the surface, each of the pair of the first electroconductive members having a peak, one of the peaks being higher than the other; and flying evaporated molecules of a metal having an atomic number larger than those of elements constituting the first electroconductive members or evaporated molecules of a compound of the metal from a side of the one of the first electroconductive members to the side of the other of the first electroconductive members to deposit the evaporated molecules on the one of the first electroconductive members.

Moreover, the present invention is a method for manufacturing an electron source equipped with a plurality of electron-emitting devices on a substrate, wherein the electron-emitting devices are manufactured by the method described above.

Moreover, the present invention is a method for manufacturing an image displaying apparatus including an electron source equipped with a plurality of electron-emitting devices on a substrate and a phosphor member emitting light by irradiation of electrons emitted from the electron-emitting devices, wherein the electron-emitting devices are manufactured by the method described above.

DETAILED DESCRIPTION OF THE PREFERRED EMBODIMENTS

A first aspect of he present invention is an electron-emitting device equipped with a pair of first electroconductive members arranged on a substrate with an interval between them, wherein the interval becomes narrower at an upper position distant from a surface of the substrate than at a position on the surface, and a peak of one of the pair of the first electroconductive members is higher than a peak of the other of the pair of the first electroconductive members, and further an electron scattering surface forming film including an element having an atomic number larger than those of elements constituting the first electroconductive members as a principal component is provided on a surface of the one of the first electroconductive members.

A second aspect of the present invention is an electron source wherein a plurality of the electron-emitting devices described above is arranged on the substrate.

A third aspect of the present invention is an image displaying apparatus including an electron source equipped with a plurality of the electron-emitting devices described above is arranged on a substrate, and a phosphor member emitting light by irradiation of electrons emitted from the electron-emitting devices.

A fourth aspect of the present invention is a method for manufacturing an electron-emitting device, including the steps of: forming a pair of first electroconductive members on a substrate with a first interval becoming narrower at an upper position distant from a surface of the substrate than at a position on the surface, each of the pair of the first electroconductive members having a peak, one of the peaks being higher than the other; and flying evaporated molecules of a metal having an atomic number larger than those of elements constituting the first electroconductive members or evaporated molecules of a compound of the metal from a side of the one of the first electroconductive members to the side of the other of the first electroconductive members to deposit the evaporated molecules on the one of the first electroconductive members.

A fifth aspect of the present invention is a method for manufacturing an electron source equipped with a plurality of electron-emitting devices on a substrate, wherein the electron-emitting devices are manufactured by the method described above.

A sixth aspect of the present invention is a method for manufacturing an image displaying apparatus including an electron source equipped with a plurality of electron-emitting devices on a substrate and a phosphor member emitting light by irradiation of electrons emitted from the electron-emitting devices, wherein the electron-emitting devices are manufactured by the method described above.

According to the present invention, an electron-emitting device having an efficiency improved by leaps and bounds can be provided, and an image displaying apparatus having an excellent display quality over a long period of time can be provided.

Figure 1A:
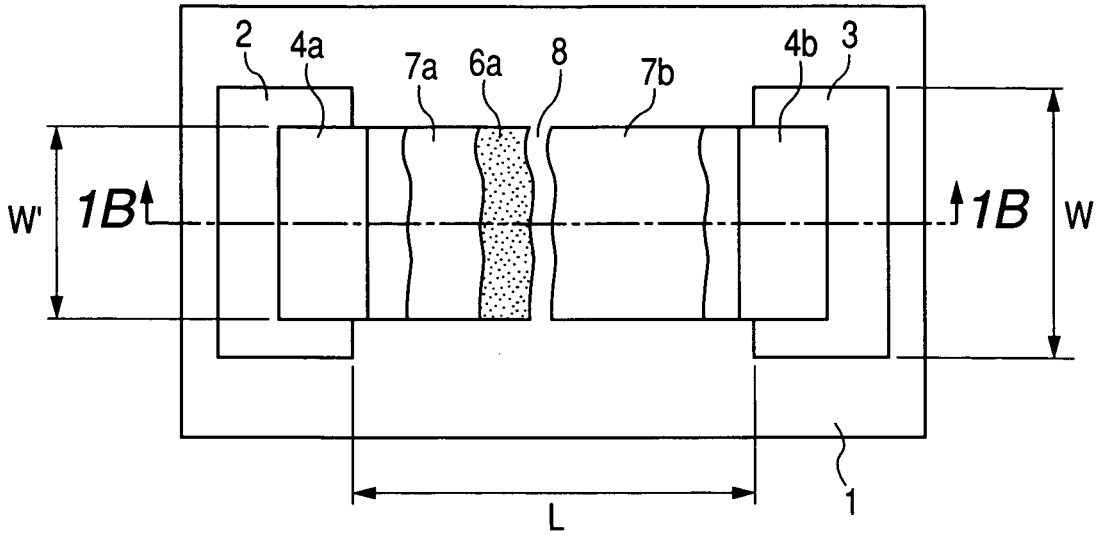
FIGS. 1A and 1B are views showing a configuration example of an electron-emitting device according to the present invention schematically.
Figure 1B:
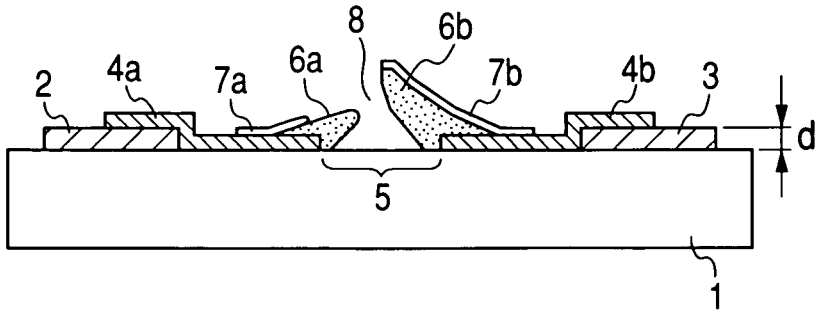

The configuration of an example of an electron-emitting device of the present invention is schematically shown in FIGS. 1A and 1B. FIG. 1A is a schematic plan view and FIG. 1B is a schematic sectional view taken along a line 1B-1B in FIG. 1A. In the figures, a reference numeral 1 denotes a substrate; reference numerals 2 and 3 denote device electrodes; reference numerals 4*a* and 4*b* denote electroconductive thin films; a reference numeral 5 denotes a gap (a second interval); reference numerals 6*a* and 6*b* denote first electroconductive members, which are carbon films in the present embodiment; reference numerals 7*a* and 7*b* denote electron scattering surface forming films; and a reference numeral 8 denotes a first interval giving an electron emission function to the first electroconductive members 6*a* and 6*b*. Moreover, as apparent from FIG. 1B, which is a schematic sectional view, the first interval 8 is narrower at an upper position distant from the surface the substrate 1 than a position on the surface. Furthermore, a pair of the first electroconductive members 6*a* and 6*b* is adapted in order that the peak of the first electroconductive member 6*b* on one side may be higher than the peak of the first electroconductive member 6*a* on the other side. Incidentally, the electron scattering surface forming films 7*a* and 7*b* do not necessarily exist on both of the pair of the first electroconductive members 6*a* and 6*b*, and at least the electron scattering surface forming film 7*b* exists on the electroconductive member 6*b* on the one side having the higher peak. In the following description, at both of the times of manufacture and a drive, the device electrode 2 is on a low potential side, and the device electrode 3 is on a high potential side.

The electron-emitting device according to the present invention is manufactured as follows. That is, a pair of second electroconductive members (the device electrode 2 and the electroconductive thin film 4*a*, and the device electrode 3 and the electroconductive thin film 4*b*) having an interval (the second interval 5) to each other is formed on the insulating substrate 1. Bipolar voltage pulses (activation voltages) having different waveforms in respective polarities are applied between the pair of the second electroconductive members to deposit the carbon films 6*a* and 6*b* being the first electroconductive members. After that, evaporated molecules of an element constituting the first electroconductive members 6*a* and 6*b*, namely a metal element having an atomic number larger than the one of carbon, or a compound of the metal in the present embodiment, are flied in a direction from the first electroconductive member 6*b* on one side (the side of the device electrode 3) toward the first electroconductive member 6*a* on the other side, and then the evaporated molecules are deposited on the electroconductive member 6*b* on the one side. For the flying of the evaporated molecules, an oblique evaporation method or the like is used. The evaporated molecules deposited on the electroconductive member 6*b* on one side in such a way form the film 7*b* consists of the metal having the atomic number larger than the one of the element constituting the first electroconductive members 6*a* and 6*b* or a compound of the metal, and such a film 7*b* functions as an electron scattering surface forming film, which elastically scatters electrons entering from the outside efficiently.

Incidentally, the electroconductive thin films 4*a* and 4*b* are not always necessary for the present invention, and the first electroconductive members 6*a* and 6*b* may be directly connected to the device electrodes 2 and 3. In this case, the second electroconductive member according to the present invention can be said to be the device electrodes 2 and 3.

In the following, more concrete manufacturing processes of the electron-emitting device of FIGS. 1A and 1B are described in detail with reference to FIGS. 2A to 2E.

Process 1

Figure 2A:
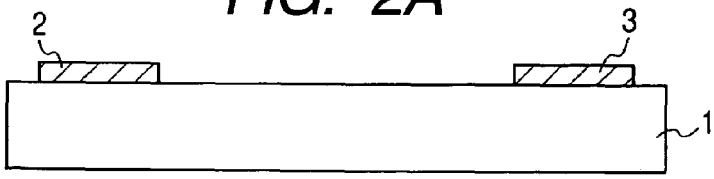
FIGS. 2A, 2B, 2C, 2D and 2E are process charts of an embodiment of a method for manufacturing the electron-emitting device of the present invention.

After fully cleaning the substrate 1 with a detergent, pure water and an organic solvent, a device electrode material is deposited by the vacuum evaporation method, the sputtering method, or the like. After that, the device electrodes 2 and 3 are formed by, for example, the photolithographic technique (FIG. 2A).

As the substrate 1, the following types can be used. That is, silica glass, glass including a content of decreased impurities such as Na, soda lime glass, a layered product stacking a soda lime glass with $SiO_2$ by the sputtering method or the like, ceramics such as alumina, a Si substrate and the like can be used.

Moreover, as the materials of the-device electrodes 2 and 3, a general conductive material can be used. The conductive material can be suitably selected from, for example, metals such as Ni, Cr, Au, Mo, W, Pt, Ti, Al, Cu and Pd, alloys of the metals, printed conductors which consist of metal or a metal oxide such as Pd, Ag, Au, $RuO_2$ and Pd-Ag and glass, transparent conductor such as $In_2O_3$—$SnO_2$, semi-conductor materials such as polysilicon, and the like.

The device electrode interval L is in a range from several tens of nm to several hundreds of μm. The device electrode interval L is set by the photolithographic technique, which is a foundation of the manufacturing method of the device electrodes 2 and 3, namely by the performance of an exposure apparatus, an etching method and the like, and a voltage applied between the device electrodes 2 and 3. But, the device electrode interval L is preferably within a range from several μm to several tens of μm.

The lengths W and the film thicknesses d of the device electrodes 2 and 3 are suitably designed on the basis of the resistance values of the electrodes, the wire connection of the electrodes with the wiring, and the problem on the arrangement of the electron source where many electron-emitting devices are arranged. Usually, the lengths W are severally within a range from several μm to hundreds of μm, and the film thicknesses d are severally within a range from several nm to several μm.

Incidentally, in the case where the carbon films 6*a* and 6*b* are directly connected to the device electrodes 2 and 3 to be arranged without using the electroconductive thin film 4, which will be described later, the interval between the device electrodes 2 and 3 may be set to be the predetermined gap 5 by the FIB method, for example. In this case, the following Process 2 and Process 3 can be omitted. In this case, the gap 5 corresponds to the interval L between the device electrodes 2 and 3. However, in order to produce the device of the present invention at a low cost, the following processes using the electroconductive thin film 4 are preferable.

Process 2

The electroconductive thin film 4 which connects the device electrodes 2 and 3 to each other is formed.

In order to acquire a good electron emission characteristic, it is preferable to use a fine particle film which consists of fine particles as the electroconductive thin film 4. The film thickness of the electroconductive thin film 4 is suitably set in consideration of the step coverage to the device electrodes 2 and 3, the resistance value between the device electrodes 2 and 3, the forming condition, which will be mentioned later, and the like.

Moreover, since the magnitudes of the device currents If, which flows the device electrodes 2 and 3, and the magnitude of the emission current Ie depend on the width W' of the electroconductive thin film 4, the electroconductive thin film 4 is designed in order that sufficient emission currents may be obtained under the limitation of the size of the electron-emitting device like the forms of the device electrodes 2 and 3.

Since there is a case where the thermal stability of the electroconductive thin film 4 governs the life of the electron emission characteristic, it is desirable to use a material having a higher melting point as the material of the electroconductive thin film 4. However, larger electric power is usually needed for energization forming, which will be described later, as the melting point of the electroconductive thin film 4 becomes higher. Furthermore, the following problem concerning the electron emission characteristic may be produced. That is, the application voltage (threshold voltage) at which electron emission can be generated rises according to the form of the electron-emitting region obtained as a result, and the like.

A material having an especially high melting point is not always needed as the material of the electroconductive thin film 4, and it is possible to select a material in the form by which a good electron-emitting region can be formed with comparatively small forming power.

As the examples of the materials meeting the condition mentioned above, the electroconductive materials such as Ni, Au, PdO, Pd and Pt which are formed to have film thicknesses at which sheet resistance Rs shows resistance values within a range from $1\times10^2$ to $1\times10^7$ Ω/□ are preferably used. Incidentally, the sheet resistance Rs is a value which appears when a resistance R obtained by measuring a thin film having a thickness t, a width w and a length l in the length direction thereof is sets as R=Rs (l/w). If resistivity is denoted by a letter ρ, then Rs=ρ/t. The film thicknesses which show the above-mentioned resistance value are almost within a range from 5 nm to 50 nm. The thin film of each material preferably has the form of a fine particle film in the film thickness range.

The particle diameters of the fine particles are within a range from several Å to several hundreds of nm, and preferably they are within a range from 1 nm to 20 nm.

Also PdO is a preferable material among the materials exemplified above owing to the following reasons and the like. That is, PdO can be easily formed to be a thin film by the baking in the air of an organic Pd compound. Because PdO is a semiconductor, PdO has a relatively low electric conductivity, and the process margin of the film thickness for obtaining the resistance value Rs within the above-mentioned range is wide. Because PdO can be easily reduced to be metal Pd after the formation of the gap 5 in the electroconductive thin film 4 or the like, the film resistance of the PdO can be decreased.

As a concrete formation method of the electroconductive thin film 4, for example, an organic metal film is formed by applying an organic metal solution between the device electrodes 2 and 3 provided on the substrate 1, and by drying the applied organic solution. Incidentally, the organic metal solution means a solution of the organic metal compound having the metals such as Pd, Ni, Au and Pt of the above-mentioned electroconductive thin film materials, as the main element of the solution. After that, the heating baking processing of the organic metal film is performed, and the processed film is patterned by performing the lift off, the etching or the like thereof to form the electroconductive thin film 4. Moreover, it is also possible to form the electroconductive thin film 4 by the vacuum evaporation method, the sputtering method, the CVD method, the distributed applying method, the dipping method, the spinner method, the inkjet method or the like.

Process 3

Successively, the device electrode 2 is set as a low potential, and the device electrode 3 is set as a high potential. Then, an energization processing called as the forming is performed by the application of a pulse-shaped voltage or a rise voltage from a power supply (not shown), and the gap 5 is formed in a part of the electroconductive thin film 4 by the energization processing. The electroconductive thin films 4*a* and 4*b* are opposed to each other in the lateral direction to the surface of the substrate 1 with the gap 5 put between them (FIG. 2C).

Incidentally, the electric processing after the forming processing is performed within a suitable vacuum apparatus.

The forming processing is performed by either the method of applying pulses each having a peak value of a constant voltage or the method of applying voltage pulses having increasing peak values. First, the voltage waveforms in the case of applying the pulses having the peak values of the constant voltage are shown in FIG. 3A.

Figure 3A:
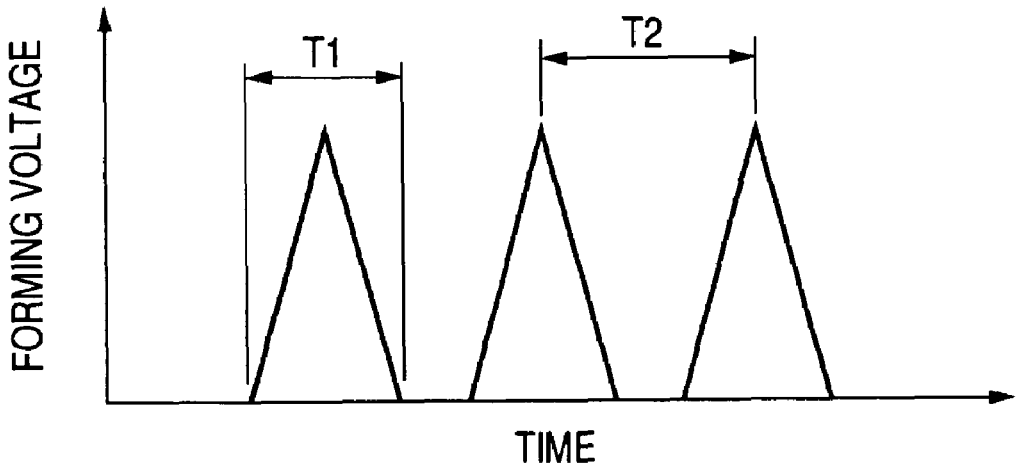
FIGS. 3A and 3B are waveform diagrams of examples of forming pulses used for the present invention.

Reference marks T1 and T2 denote the pulse width and the pulse intervals of the voltage waveforms, respectively, in FIG. 3A. The pulse width T1 is set to be within a range from 1 μsec to 10 msec, and the pulse interval T2 is set to be in a range from 10 μsec to 100 msec. The peak values (peak voltages at the time of the forming) of the triangular waves are suitably selected.

Figure 3B:
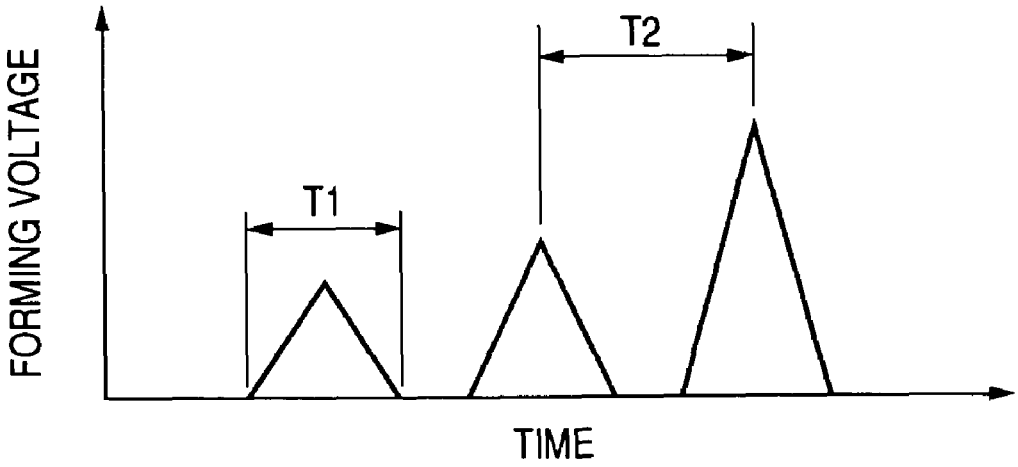

Next, the voltage waveforms in the case of applying the voltage pulses having increasing peak values are shown in FIG. 3B.

Reference marks T1 and T2 denote the pulse width and the pulse interval of the voltage waveforms, respectively, in FIG. 3B. The voltage width T1 is set to be in a range from 1 μsec to 10 msec, and the pulse interval T2 is set to be in a range from 10 μsec to 100 msec. The peak values (peak voltages at the time of the forming) of the triangular waves increases by, for example, about every 0.1 V step.

Incidentally, the forming processing is ended at the following time point. That is, a voltage having a degree of a magnitude which does not destroy and deform the electroconductive film 4 locally, for example, a pulse voltage of about 0.1 V, is inserted between the pulses for forming to measure a device current. Thereby, a resistance value is obtained, and the forming processing is ended at the time point when the resistance value shows, for example, a value equal to 1000 times or more of the resistance before the forming processing.

Although the forming processing is performed for forming the gap 5 described above by applying the triangular wave pulses between the device electrodes 2 and 3, the waveform of the wave applied to the part between the device electrodes 2 and 3 is not limited to the triangular wave, and a desired waveform such as a rectangular wave can be used. Also the peak values, the pulse widths, the pulse intervals of the waves are not limited to the values described above, and suitable values are selected according to the resistance value of the electron emitting device, and the like in order that the gap 5 may be formed in a good condition.

Process 4

Activation processing is performed to the device in which the forming has ended. The activation processing is performed by applying a voltage between the device electrodes 2 and 3 in a suitable degree of vacuum in an atmosphere including a carbon compound gas. By performing the activation processing, the carbon films 6*a* and 6*b* including carbon or a carbon compound from the carbon compound existing in the atmosphere as the principal components of the carbon films 6*a* and 6*b* are deposited on the electroconductive thin films 4*a* and 4*b*, and the device current If and the emission current Ie come to change remarkably.

The carbon and/or the carbon compound here mean ones, for example, graphite (including the so-called HOPG, PG and GC. HOPG indicates an almost complete crystal structure of graphite, PG indicates a somewhat disturbed crystal structure having crystal grains each of a degree of 20 nm, and GC indicates a still largely disturbed crystal structure having crystal grains each of a degree of 2 nm), and amorphous carbon (indicating the amorphous carbon, and a mixture of the amorphous carbon and the fine crystal of the graphite).

As the suitable carbon compounds used for the activation process, there can be cited aliphatic hydrocarbons such as alkane, alkene and alkyne, aromatic hydrocarbons, alcohols, aldehydes, ketones, amines, organic acids such as phenol, carvone and sulfonic acid, and the like. To put it concretely, there can be used saturation hydrocarbons expressed by $C_nH_{2n+2}$ such as methane, ethane and propane, unsaturated hydrocarbon expressed by composition formulae such as $C_nH_{2n}$ such as ethylene and propylene, benzene, toluene, methanol, ethanol, formaldehyde, acetaldehyde, acetone, methyl ethyl ketone, methylamine, ethylamine, phenol, benzonitrile, tolunitrile, formic acid, acetic acid, and propionic acid, and mixtures of them.

In the present invention, as shown in FIGS. 1A and 1B, it is necessary to form asymmetrically the forms of the carbon films 6*a* and 6*b* formed by the activation processing on the low potential side and the high potential side of the device electrodes 2 and 3. Accordingly, for example, the pulse widths of the bipolar voltage pulse applied between the device electrodes 2 and 3 are set in order to be different from each other.

The forms of the carbon films 6*a* and 6*b* are influenced by the voltage waveforms applied to the device, the pressure of the carbon compound to be introduced, the diffusion mobility on the surface of the device, the average residence time on the surface of the device, and the like. Moreover, the easiness of handling such as the easiness of introduction into the vacuum apparatus and the easiness of the exhaustion after the activation is also important.

As a result of examining various carbon compounds from the points of view described above, it was found that good controllability could be obtained especially in case of using tolunitrile (toluene cyanide) or acrylonitrile. Although the carbon-containing gas is introduced into the vacuum space through a slow leak valve and a partial pressure thereof is somewhat influenced by the shape of the vacuum apparatus and the members used for the vacuum apparatus. The partial pressure is suitable within a range about from $1\times10^{-5}$ Pa to $1\times10^{-2}$ Pa.

Figure 4:
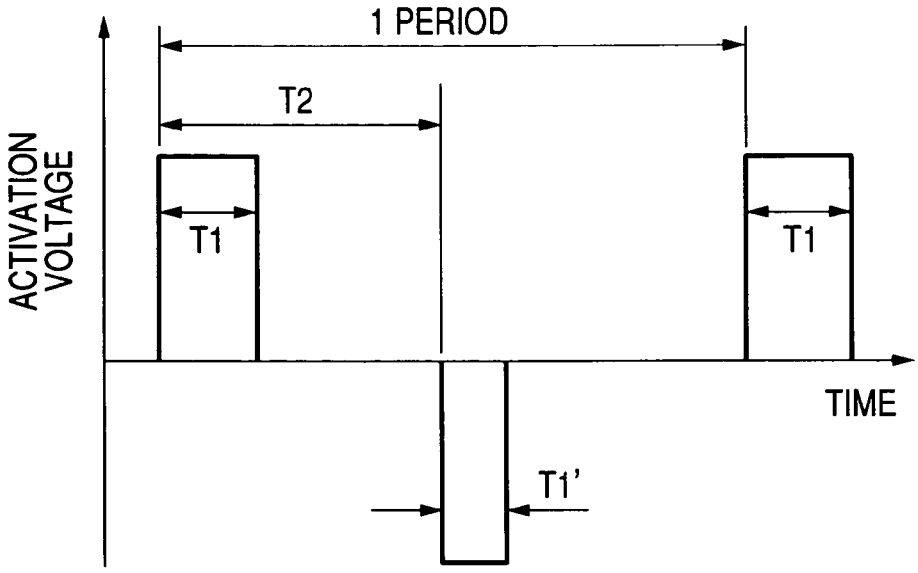
FIG. 4 is a waveform diagram of an example of an activation pulse used for the present invention.

FIG. 4 shows an example of the waveforms of the activation voltage pulses which can be used suitably for the present invention. The maximum voltage value to be applied is suitably selected in a range from 10 to 26 V. Reference marks T1 and T1' denote positive and negative pulse widths of the voltage waveforms, respectively. A reference mark T2 denotes a pulse interval. The pulse width T1 is set to be larger than the pulse width T1'. The absolute values of the positive and the negative voltage values are set to be equal to one another.

In the activation process, when the bipolar voltage pulses having different pulse widths from each other as shown in FIG. 4 are applied between the device electrodes 2 and 3, a carbon film begins to deposit in the gap 5 and on the electroconductive thin films 4*a* and 4*b* in the neighborhood of the gap 5. In the process, the carbon films 6*a* and 6*b* are simultaneously deposited also in a perpendicular direction to the paper surface.

Further, when the activation processing is continued, the formation of the carbon films 6*a* and 6*b* advances, and the carbon films 6*a* and 6*b* are growing upper than the surface of the electroconductive thin film 4*a* and 4*b* surface. And the activation processing is ended when the carbon films 6*a* and 6*b* have had the forms finally shown in FIGS. 1A and 1B (FIG. 2D).

In the case where the end of the activation process is determined by the measurement of the device current, the activation process is ended at the time point when the emission current Ie has almost reached its saturation.

In the case where the bipolar voltage pulses having the pulse widths T1 and T1' satisfying the relation T1>T1' as shown in FIG. 4 are applied during the activation process in the state in which the electric potential of the device electrode 3 is positive, the asymmetrical structure in which the height of the carbon film 6*b* connected to the device electrode 3 electrically from the surface of the substrate is higher than that of the carbon film 6*a* connected to the device electrode 2 electrically as shown in FIGS. 1A and 1B can be made.

Process 5

A stabilization process is preferably performed for the electron-emitting device produced as mentioned above. The process is a process for exhausting the carbon compounds in the vacuum chamber. Although the carbon compounds in the vacuum chamber are preferably eliminated as much as possible, the partial pressure of the carbon compounds is preferably $1\times10^{-8}$ Pa or less. Moreover, the pressure including the other gases is preferably $1\times10^{-6}$ Pa or less, and especially the pressure is more preferably $1\times10^{-7}$ Pa or less. A vacuum exhausting apparatus which does not use oil is used as the vacuum exhausting apparatus for exhausting the vacuum chamber lest the oil produced from the apparatus should influence the characteristic of the device. To put it concretely, the vacuum exhausting apparatus such as a sorption pump and an ion pump can be cited. Furthermore, the whole of the vacuum chamber is heated at the time of the exhaustion of the inside of the vacuum chamber to make it easy to exhaust the carbon compound molecules attached to the inner wall of the vacuum chamber and the electron-emitting device. It is to be desired that the heating is performed for a period of time as long as possible under the heating condition within a range from 150 to 350° C., preferably at 200° C. or higher. But, the heating condition is not limited to that condition. The heating is performed under a condition suitably selected according to the conditions of the size and the shape of the vacuum chamber, the arrangement of the electron-emitting device, and the like.

Although it is desirable to maintain the atmosphere at the time of the end of the above-mentioned stabilization processing as for the atmosphere after performing the stabilization process, the atmosphere is not limited to that. As long as the carbon compounds are sufficiently removed, the atmosphere can keep a sufficiently stable characteristic even if the pressure itself somewhat rises.

Since the deposition of new carbon or carbon compounds can be suppressed by adopting such a vacuum atmosphere, the shape of the film containing the carbon of the present invention is maintained, and the device current If and the emission current Ie are stabilized as a result.

Process 6

Figure 2B:
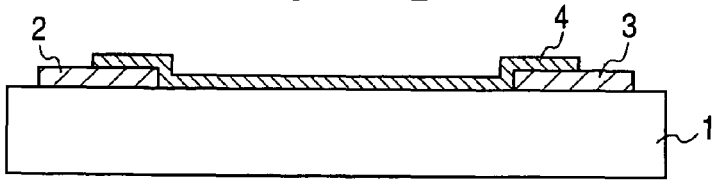
Figure 2C:
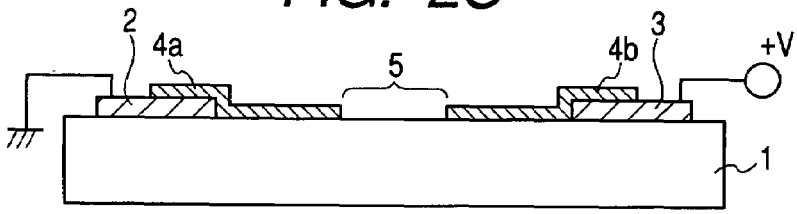
Figure 2D:
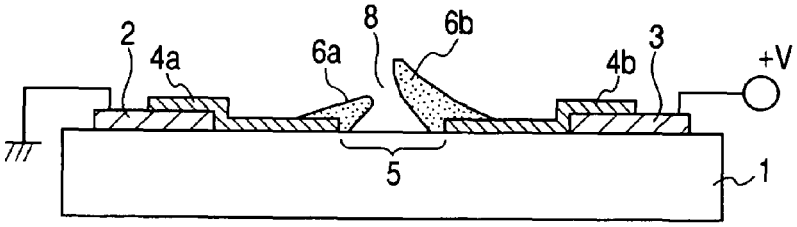
Figure 2E:
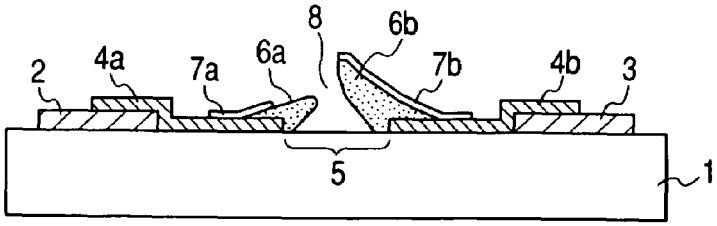

A metal or a metal compound is deposited on the carbon films 6*a* and 6*b* by the oblique evaporation after the stabilization process, and thereby the electron scattering surface forming films 7*a* and 7*b* are formed (FIG. 2E). The angle of the oblique evaporation is preferably an angle θ1 within a range from 10° to 90° from the normal vector of the substrate 1 toward the side of the positive electrode (device electrode 3) at the time of the application of the voltages.

In the present invention, since the electron scattering surface forming film 7*b* completely covers the carbon film 6*b* on the side of the high potential by the oblique evaporation, the elastic scattering efficiency of electrons on the device electrode 3 on the side of high potential increases, and electron scattering is more effectively produced by an electron scattering body. As a result, the emission current If increases. Moreover, since an electron scattering surface forming film is not formed in the gap 8 owing to the influence of the carbon film 6*b* on the side of the high potential, the device current If does not change, but only the emission current Ie increases.

The atomic structure factor, to electron beams, of the metal or the metal compound used at the present process is larger than that of carbon.

Here, a simple description is given to the atomic structure factor E(θ) to the electron beams. At a place where the scattering angle of an electron beam is large, the following expression can be obtained:

$$E(\theta)=e^2Z/2mv^2\sin^2\theta.$$

Consequently, the atomic structure factor E is in proportion to the atomic number Z, and heavy elements strongly scatter electrons. Therefore, since the atomic structure factor of a larger atomic number to an electron beam is roughly larger, the atomic number of the metal or the metal compound which is evaporated obliquely is preferably larger than that of carbon. Consequently, for example, Pb, Au, Pt, W, Ta, Ba, Hf, and the like are suitable as stable and heavy elements.

Moreover, as the metal compound, oxides such as PbO and BaO, borides such as $HfB_2$ and $ZrB_2$, carbides such as HfC, ZrC, TaC and WC, and nitrides such as HfN, ZrN and TiN are preferably used.

The electron scattering surface forming film 7*b* is formed on the carbon film 6*b* on the side of the high potential, and further on the high potential side electroconductive thin film 4*b* and the high potential side device electrode 3, which are on the extension of the carbon film 6*b*, as the need arises. In the present invention, although the electron scattering surface forming film 7*a* may be formed on the low potential side, no electron scattering surface forming film is formed in the gap 5.

The feature of the electron-emitting device according to the present invention is that the height of the high potential side carbon film 6*b* is formed to be higher than that of the low potential side carbon film 6*a* in the direction perpendicular to the surface of the substrate 1.

It is also the feature of the electron-emitting device to include the electron scattering surface forming film 7*b* having the high efficiency of performing the elastic scattering of the electrons entering the carbon film 6*b*.

Furthermore, it is also the feature of the electron-emitting device that no electron scattering surface forming films having the high efficiency of performing the elastic scattering of the entering electrons are formed in the gap 5.

Figure 5:
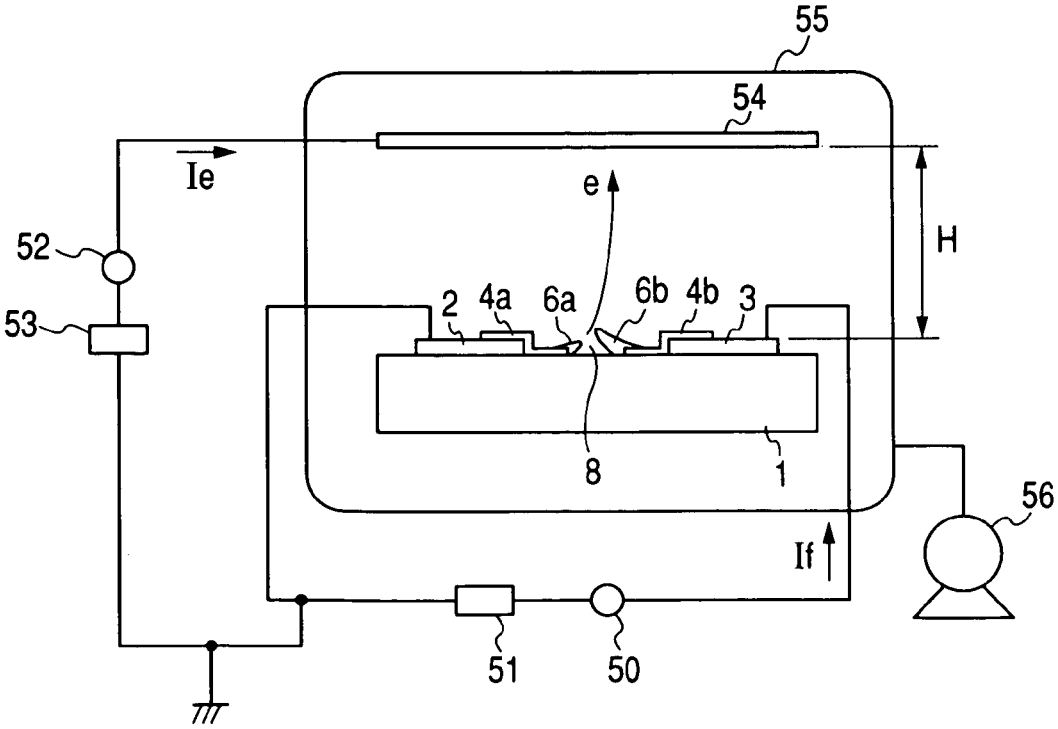
FIG. 5 is a schematic diagram showing an example of a vacuum apparatus equipped with a measurement evaluation function of the electron-emitting device according to the present invention.

The basic characteristic of the electron-emitting device according to the present invention is evaluated by a measurement evaluation apparatus shown in FIG. 5. In the following, the measurement evaluation apparatus is described.

In a measurement of the device current If flowing between the device electrodes 2 and 3 of the electron-emitting device and the emission current Ie to an anode electrode 54, a power supply 51 and an ammeter 50 are connected to the device electrodes 2 and 3, and the anode electrode 54, to which a power supply 53 and an ammeter 52 are connected, is disposed above the electron-emitting device. In FIG. 5, each member of the electron-emitting device is denoted by the same mark as that shown in FIGS. 1A and 1B. Incidentally, the electron scattering surface forming films 7*a* and 7*b* of the electron-emitting device are omitted for convenience. Moreover, the reference numeral 51 denotes the power supply for applying a device voltage Vf to the device, and the reference numeral 50 denotes the ammeter for measuring the device current If flowing the electroconductive thin films 4*a* and 4*b* including the electron-emitting region 8 between the device electrodes 2 and 3. The reference numeral 54 denotes the anode electrode for catching the emission current Ie emitted from the electron-emitting region 8, the reference numeral 53 denotes the high-voltage power supply for applying a voltage to the anode electrode 54, and the reference numeral 52 denotes the ammeter for measuring the emission current Ie emitted from the electron-emitting region 8 of the device.

Moreover, the present electron-emitting device and the anode electrode 54 are set in a vacuum apparatus 55, and the vacuum apparatus 55 is provided with equipment necessary for the vacuum apparatus 55 such as an exhaust pump 56 and a vacuum gauge (not shown) to make it possible to perform the measurement evaluation of the present device in a desired vacuum. Incidentally, the voltage of the anode electrode 54 is measured within a range from 1 kV to 10 kV, and the distance H between the anode electrode 54 and the electron-emitting device is measured within a range from 2 mm to 8 mm.

An electron source can be configured by arranging a plurality of electron-emitting devices according to the present invention on a substrate, and an image displaying apparatus can be configured by combining the electron source and a phosphor member which emits light by the electrons emitted from the electron-emitting devices. As a method for manufacturing the electron source and the image displaying apparatus, as long as the method is one for manufacturing the electron-emitting devices being constituting members by the manufacturing method of the present invention, it is not limited especially how to manufacture the other members.

In the electron source which is configured to use the electron-emitting devices according to the present invention, the arrangement of the electron-emitting devices is not especially limited, but the so-called passive matrix arrangement is preferably applied. The passive matrix arrangement is an arrangement form in which n Y-direction wires are installed on m X-direction wires with an interlayer insulation layer put between the wires and the X-direction wires and the Y-direction wires are connected to a pair of device electrodes of each of the electron-emitting devices, respectively. In the following, the passive matrix arrangement is described in detail.

Figure 6:
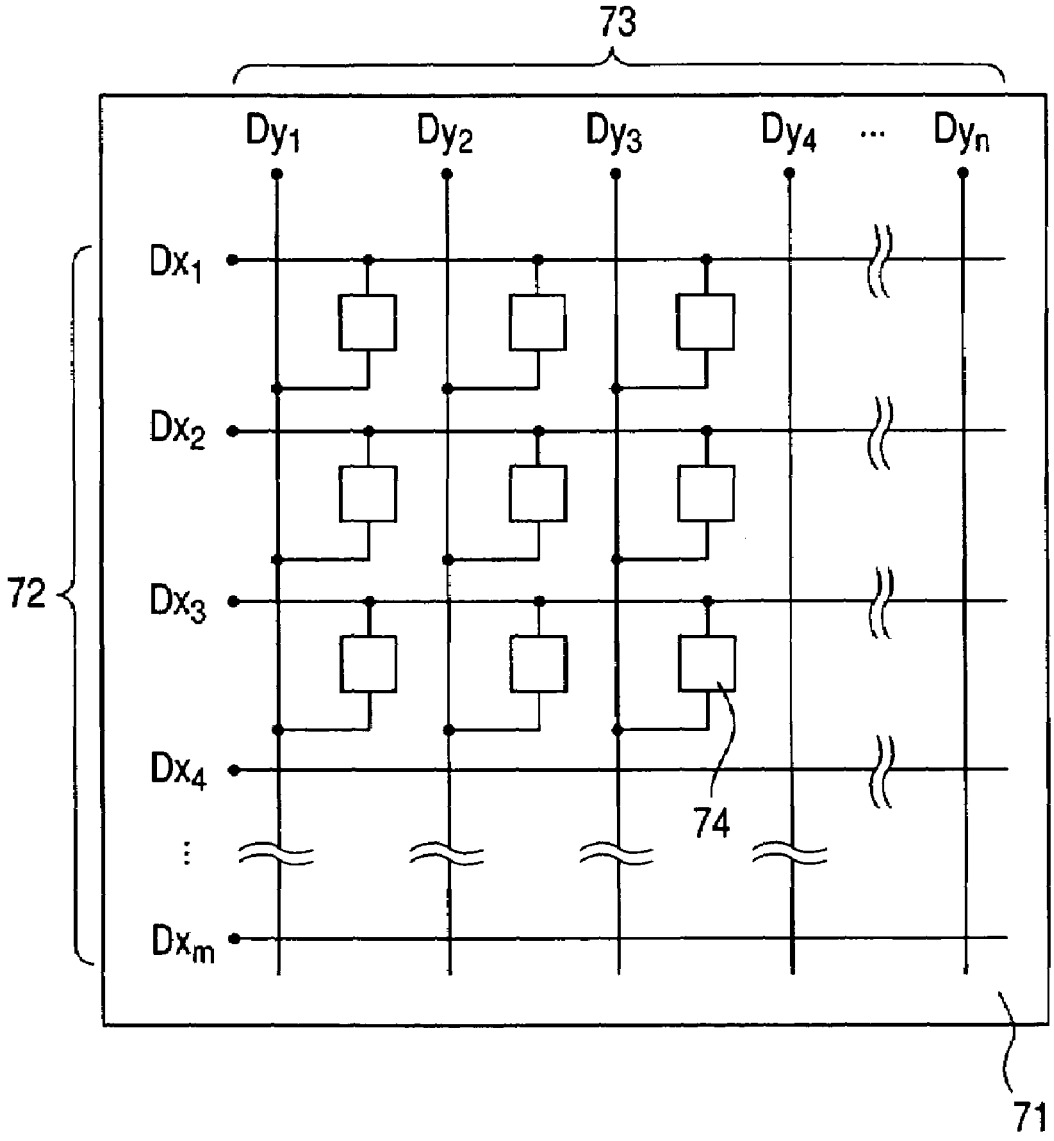
FIG. 6 is a schematic plan view showing the configuration of an example of an electron source base according to the present invention.

In the following, the configuration of the electron source base configured based on this principle is described with reference to FIG. 6. In FIG. 6, a reference numeral 71 denotes an electron source base, a reference numeral 72 denotes the X-direction wires, a reference numeral 73 denotes the Y-direction wires, and a reference numeral 74 denotes electron-emitting devices.

In FIG. 6, the m X-direction wires 72 are composed of wires Dx1, Dx2, . . . , Dxm, and consist of an electroconductive metal or the like formed on the base 71 consists of an insulating substrate by the vacuum evaporation method, the printing method, the sputtering method or the like to be a desired pattern. The material, the film thicknesses and wiring widths of the X-direction wires 72 are set in order to supply almost equal voltages to many electron-emitting devices. The Y-direction wires 73 are composed of n wires Dy1, Dy2, . . . , Dyn, and like the X-direction wires 72, the Y-direction wires 73 consist of an electroconductive metal in a desired pattern which is formed by the vacuum evaporation method, the printing method, the sputtering method or the like. The material, the film thicknesses and the wiring widths of the Y-direction wires 73 are set in order to supply almost equal voltages to many electron-emitting devices. An interlayer insulation layer (not shown) is installed between the m X-direction wires 72 and the n Y-direction wires 73, and thereby the m X-direction wires 72 and the n Y-direction wires 73 are electrically separated. Thus matrix wiring is configured (wherein both of m and n indicate positive integers).

The interlayer insulation layer (not shown) consists of $SiO_2$ or the like which is formed by the vacuum evaporation method, the printing method, the sputtering method or the like. The interlayer insulation layer is formed over the whole of or a part of the surface of the insulating substrate 7, on which the X-direction wires 72 are formed. In particular, the film thickness, the material and the manufacturing method of the interlayer insulation layer are suitably set in order that the interlayer insulation layer can resist the potential difference at the intersection parts of the X-direction wires 72 and the Y-direction wires 73. The X-direction wires 72 and the Y-direction wires 73 are pulled out as external terminals severally.

Furthermore, like the above, opposing device electrodes (not shown) of the electron-emitting devices 74 are electrically connected to the m X-direction wires 72 (Dx1, Dx2, . . . , Dxm) and the n Y-direction wires 73 (Dy1, Dy 2, . . . , Dyn) through wire connections consist of an electroconductive metal or the like formed by the vacuum evaporation method, the printing method, the sputtering method or the like.

Although the details will be mentioned later, to the X-direction wires 72, scanning signal applying means (not shown) for applying scanning signals for scanning the rows of the electron-emitting devices 74 arranged in the X directions according to an input signal is electrically connected. On the other hand, to the Y-direction wires 73, modulating signal generating means (not shown) for applying modulating signals for modulating each of the columns of the electron-emitting devices 74 arranged in the Y directions according to the input signal is electrically connected.

Moreover, the drive voltage applied to each of the electron-emitting devices 74 is supplied as a difference voltage of a scanning signal and a modulating signal applied to the device.

Figure 7:
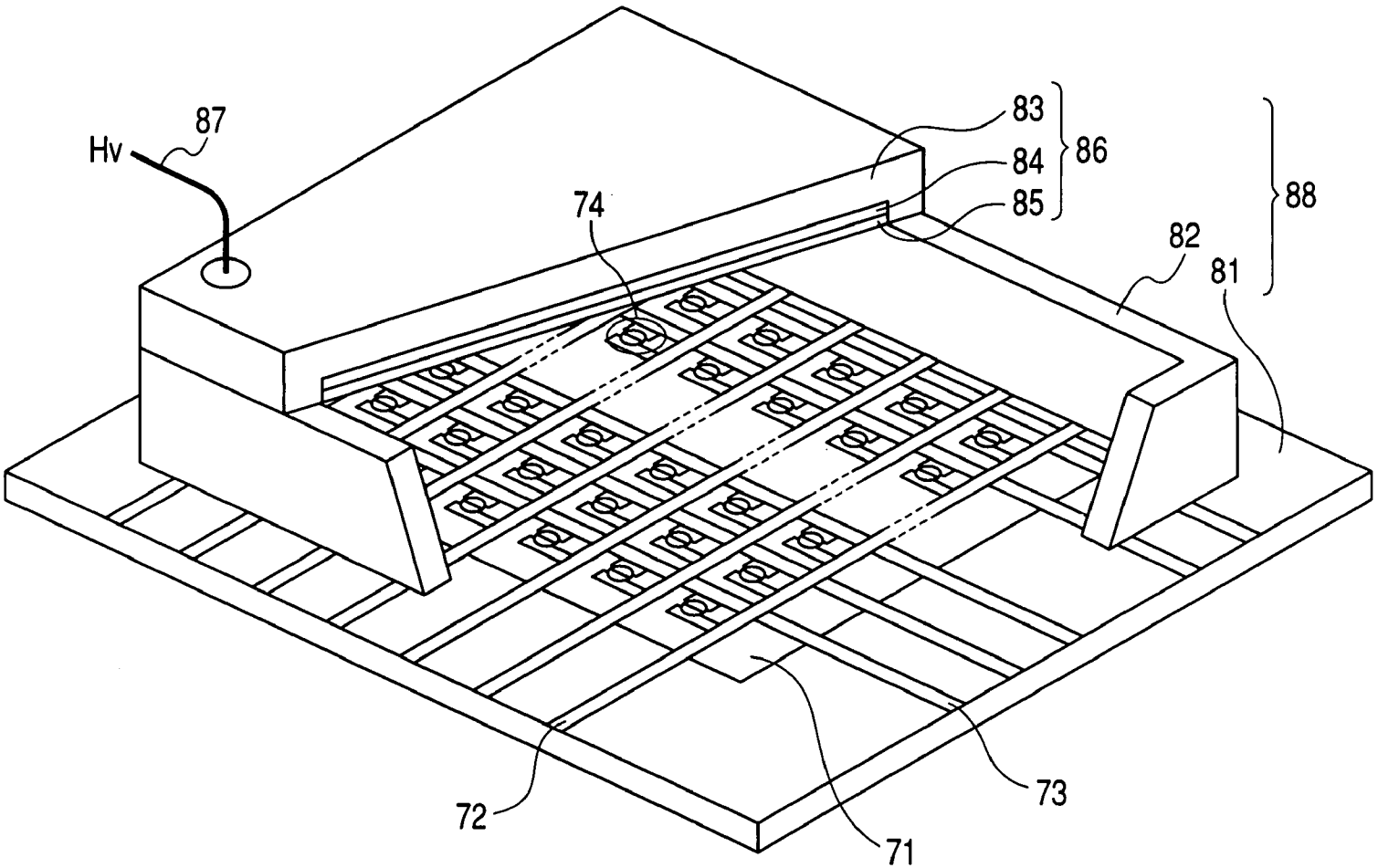
FIG. 7 is a schematic view showing the configuration of a display panel of an image displaying apparatus using the electron source base of FIG. 6.
Figure 8A:
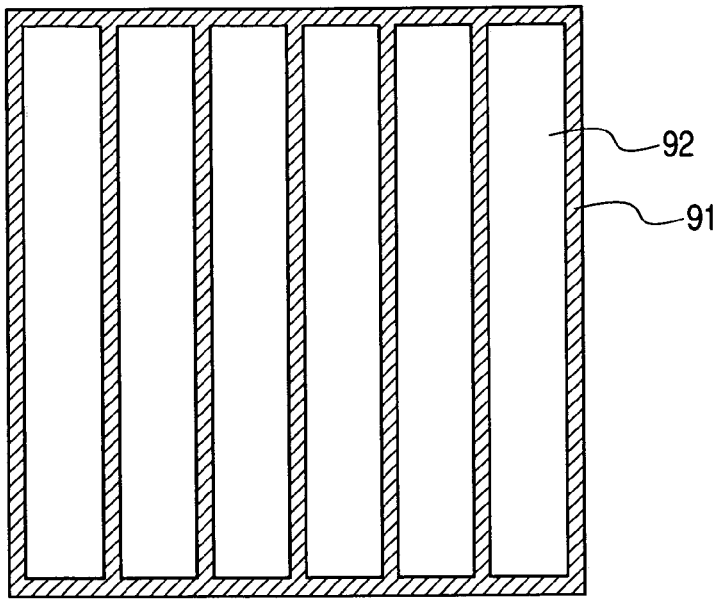
FIGS. 8A and 8B are schematic plan view showing examples of the configurations of fluorescent films used for the display panel of FIG. 7.
Figure 8B:
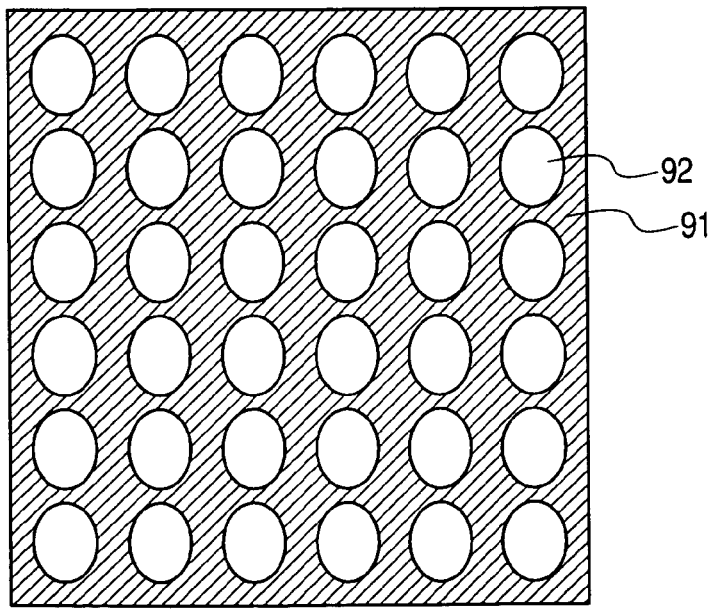

Next, an example of the image displaying apparatus using the electron source of the above-mentioned passive matrix arrangement is described with reference to FIG. 7 and FIGS. 8A and 8B. FIG. 7 is a perspective view schematically showing the basic configuration of a partially broken display panel of an image displaying apparatus. FIGS. 8A and 8B are plan views of an configuration example of a fluorescent film used for the display panel.

In FIG. 7, a reference numeral 81 denotes a rear plate to which the electron source base 71 is fixed, and a reference numeral 86 denotes a face plate composed of a glass substrate 83 on the inner surface of which a fluorescent film 84, a metal-back 85 and the like are formed. A reference numeral 82 denotes a supporting frame. An envelope 88 is configured by coating frit glass on the rear plate 81, the supporting frame 82 and the face plate 86, and by baking the coated rear plate 81, the supporting frame 82 and the face plate 86 at a temperature within a range from 400 to 500° C. for ten minutes or more in the air or in the atmosphere of nitrogen, to perform the seal bonding of them. Incidentally, the same members as those shown in FIG. 6 are denoted by the same marks as those in FIG. 6.

Although the envelope 88 is composed of the face plate 86, the supporting frame 82 and the rear plate 81 as described above, the rear plate 81 is provided chiefly with the aim of reinforcing the strength of the electron source base 71. Consequently, in the case where the base 71 itself has a sufficient strength, the rear plate provided separately is not necessary. Then, the supporting frame 82 may be directly seal-bonded to the base 81, and the envelope 88 may be configured by the face plate 86, the supporting frame 82 and the base 71.

On the other hand, by installing supporting bodies (not shown) called as the spacers between the face plate 86 and the rear plate 81, an envelope 88 having a sufficient strength to the atmospheric pressure also can be configured.

Configuration examples of the fluorescent film 84 are shown in FIGS. 8A and 8B. In the drawings, a reference numeral 91 denotes a black electroconductive material, and a reference numeral 92 denotes a phosphor. The fluorescent film 84 consists of only the phosphor 92 in case of monochrome. But, in the case of the fluorescent film of color, the fluorescence film 84 consists of the black electroconductive material 91 and the phosphors 92, which are called as a black stripe (FIG. 8A) or a black matrix (FIG. 8B) according to the arrangement of the phosphors 92. The purpose of providing the black stripe or the black matrix is to make the color mixing or the like inconspicuous by blackening the toned portions among the respective phosphors 92 of the three primary color phosphors, which become necessary at the time of color display, and to suppress the lowering of the contrast owing to the reflection of external light on the fluorescent film 84. As the material of the black electroconductive material 91, there is a material including graphite as the principal component, which is usually used frequently, but the material is not limited to that material. As long as a material having electrical conductivity and the properties of little light transmission and light reflection, the material can be used as the black electroconductive material 91.

As the method for applying the phosphor on the glass substrate 83, the precipitation method, the printing method and the like are used independent of the monochrome display or the color display.

Moreover, the metal-back 85 is usually formed on the inner surface side of the fluorescent film 84. The purposes of the provision of the metal-back 85 are raising luminance by performing the mirror reflection of the light toward the inner surface side in the light emitted by the phosphor to the side of the face plate 86, making the metal-back 85 act as an electrode for applying an electron beam accelerating voltage, protecting the phosphor from being damaged by the collision of the negative ions generated in the envelope 88, and the like. The metal-back 85 can be produced by performing smoothing processing (usually called as filming) of the surface on the inner surface side of the fluorescent film 84 after the production of the fluorescent film 84, and by depositing aluminum in vacuum evaporation or the like after that.

In order to raise the electrical conductivity of the fluorescent film 84, a transparent electrode (not shown) may be further provided to the face plate 86 on the outer surface side of the fluorescent film 84.

When the above-mentioned seal bonding is performed, each color phosphor should be made to correspond with an electron-emitting device in case of a color display. Accordingly, it is necessary to perform sufficient alignment.

The sealing of the envelope 88 is performed after making the inside of the envelope 88 be at the degree of vacuum of about $1.3\times10^{-5}$ Pa through an exhaust pipe (not shown). Moreover, getter processing is sometimes performed in order to maintain the degree of vacuum after the sealing of the envelope 88. The getter processing is the processing of heating a getter (not shown) disposed at a predetermined position in the envelope 88 by a heating method such as the resistance heating or the high frequency heating immediately before of after the sealing of the envelope 88 for forming an evaporated film. Ba or the like is usually the principal component of the getter, and the degree of vacuum within a range, for example, from $1.3\times10^{-3}$ Pa to $1.3\times10^{-5}$ Pa is kept by the absorption operation of the evaporated film.

In the image displaying apparatus which has completed in the way described above, an image is displayed by making each electron-emitting device 74 emit electrons by applying voltages to the X-direction wires 72 and the Y-direction wires 73 through the external terminals of the container, and by accelerating electron beams to collide with the fluorescent film 84 by applying a high voltage equal to several kV or more to the metal-back 85 or the transparent electrode (not shown) through a high-voltage terminal 87, and thereby by performing excitation and light-emission.

EXAMPLE 1

An electron-emitting device having the configuration shown in FIGS. 1A and 1B was produced in accordance with the processes shown in FIGS. 2A to 2E.

Process a

First, a pattern to be the device electrodes 2 and 3 and a desired gap L between the device electrodes 2 and 3 was formed on a cleaned quartz substrate 1 with photoresist (RD-2000N-41 made by Hitachi Chemical Co., Ltd.), and Ti and Pt were deposited to be the thicknesses of 5 nm and 30 nm, respectively, in order by the electron beam evaporation method. The photoresist pattern was dissolved by an organic solvent, and the lift off of the Pt/Ti deposition films were carried out. Then, the device electrode interval L was set to 3 μm, and the device electrodes 2 and 3 having the width W of 500 μm of the device electrodes were formed (FIG. 2A).

Process b

A Cr film having a film thickness of 100 nm was deposited by the vacuum evaporation, and the patterning was performed to have an opening corresponding to the form of an electroconductive thin film, which will be described later. An organic palladium compound solution (ccp4230 made by Okuno Chemical Industries Co., Ltd.) was coated on the Cr film while being rotated by a spinner, and the heat baking processing at 300° C. for 12 minutes was performed. Moreover, the film thickness of the electroconductive thin film 4 which consists of Pd as the principal element formed in the way mentioned above was 10 nm, and the sheet resistance Rs thereof was $2\times10^4$ Ω/□.

Process c

The Cr film and the electroconductive thin film 4 after baking were etched by an acid etchant, and the electroconductive thin film 4 of a desired pattern with the width W' of the electroconductive thin film 4 being 300 μm was formed (FIG. 2B).

According to the above-mentioned process, the device electrodes 2 and 3 and the electroconductive thin film 4 were formed on the substrate 1.

Incidentally, devices of comparative examples 1 and 2 were produced by the quite same processes.

Process d

Next, the above-mentioned device was set in the measurement evaluation apparatus of FIG. 5. After the inside of the measurement evaluation apparatus was exhausted with the vacuum pump and the pressure of the inside had reached the degree of vacuum of $1\times10^{-6}$ Pa, a voltage was applied between the device electrodes 2 and 3 from the power supply 51 for applying the device voltage Vf to the device, and the forming processing was performed. Thereby, the gap 5 was formed in the electroconductive thin film 4, and the electroconductive thin film 4 was separated into the electroconductive thin films 4*a* and 4*b* (FIG. 2C). The voltage waveforms of the forming processing were ones shown in FIG. 3B. In the present example, the pulse width T1 was set to be 1 msec, and the pulse interval T2 was set to be 16.7 msec. The peak values of the triangular waves were raised by a step of 0.1 V to perform the forming processing. Moreover, during the forming processing, a resistance measurement pulse having a voltage of 0.1 V was simultaneously inserted between the pulses for forming to measure the resistance. Incidentally, the end of the forming processing was set at the time when the measured value by the resistance measurement pulse became 1 MΩ or more, and the application of the voltages to the device was ended simultaneously.

Process e

Successively, in order to perform an activation process, tolunitrile was introduced in the vacuum apparatus 1 through the slow leak valve, and the pressure of $1.0\times10^{-4}$ Pa was maintained. Next, the activation processing of the device which had processed by the forming processing was performed using the waveform shown in FIG. 4 through the device electrodes 2 and 3, in which waveform the pulse width T1 was set to 1 msec, the pulse width T1' was set to 0.1 msec, the pulse interval T2 was set to 10 msec, and the maximum voltage values were set to be ±22 V. In this case, the voltages given to the device electrode 3 were made to be positive, and the direction of the device current If flowing from the device electrode 3 to the device electrode 2 was set to be positive. After having confirmed that the device current If had been saturated after about 30 minutes, current conduction was stopped, and the slow leak valve was closed to end the activation processing.

The device of the comparative example 1 was produced according to the completely same process. On the other hand, the activation processing similar to that of the device of the present example except for the setting of the pulse width T1 being 1 msec, the pulse width T1' being 1 msec, and the pulse interval T2 being 10 msec in the waveform shown in FIG. 4 was performed to the device of the comparative example 2 which had received the same forming process as that of the device of the present example.

Process f

Successively, a stabilization process was performed. The exhausting of the inside of the vacuum apparatus was continued while keeping the vacuum apparatus and the electron-emitting device at about 250° C. by heating them with a heater. The heating with the heater was stopped after 20 hours, and the temperature of the inside of the vacuum apparatus was returned to the room temperature. Then, the pressure in the inside of the vacuum apparatus reached about $1\times10^{-8}$ Pa.

Process g

Successively, an electron scattering surface forming film producing process was performed. While the pressure in the vacuum apparatus was kept at $1\times10^{-8}$ Pa, Au (atomic number 79) as a material having a large atomic structure factor to electron beams was obliquely evaporated from the device electrode on the high potential side as the electron scattering surface forming film. Several atomic layers were evaporated by inclining evaporation molecular beam flows coming flying from a heated evaporation source by an angle θ1=45° from the normal line of the substrate 1 after the forming processing. Although a part of the Au was stacked on the substrate 1, the device electrodes 2 and 3, and the electroconductive thin films 4*a* and 4*b* including the electron-emitting region 8, no evils were produced by the stacking.

By the completely same process, an electron scattering surface forming film was produced in the device of the comparative example 2. No electron scattering surface forming films were produced in the device of the comparative example 1.

Successively, the electron emission characteristic was measured.

The distance H between the anode electrode 54 and the electron-emitting device was set to 4 mm, and the electric potential of 1 kV was given to the anode electrode 54 with the high voltage power supply 53. In this state, rectangular pulse voltages having the peak values of 15 V were applied between the device electrodes 2 and 3 with the power supply 51, and the device currents If and the emission currents Ie of the device of the example and the devices of the comparative examples were measured with the ammeter 50 and the ammeter 52, respectively.

In the device of the present example, the device current If was 0.33 mA, the emission current Ie was 2.4 μA, and the electron emission efficiency η (=Ie/If) was 0.72%. In the device of the comparative example 1, the device current If was 0.34 mA, the emission current Ie was 1.77 μA, and the electron emission efficiency η (=Ie/If) was 0.52%. In the comparative example 2, no stable emission currents Ie could be measured because large leakage currents flowed.

From the results, it was found that the device of the present example had a large emission current Ie and a superior electron emission efficiency η in comparison with the devices of the comparative examples.

Moreover, the observation of the device of the present example and the devices of the comparative examples which were produced by the above-mentioned processes was performed with an atomic force microscope (AFM).

The observations of the forms of the planes including the electron-emitting regions 8 of the devices were performed using the atomic force microscope. The form of the device of the present example was the same as the plane form shown in FIGS. 1A and 1B. That is, the carbon films 6*a* and 6*b* and the electron scattering surface forming films 7*a* and 7*b* were observed on both the sides of the gap 5 formed in the electroconductive thin film 41. Moreover, from the height information acquired by the atomic force microscope, the height of the highest portion of the electron scattering surface forming film is at a position higher by about 80 nm from the surfaces of the electroconductive thin films 4*a* and 4*b*, and the electron scattering surface forming film 7*b* at the height had the belt-like form having an width of about 50 nm. On the other hand, the observation of the electron scattering surface forming film was similarly performed to the device of the comparative example 2. The height of the electron scattering surface forming film was almost uniform, and no belt-like forms like the device of the present example were observed.

Moreover, by performing the elemental analysis of the deposit in the neighborhood of the gap 5 formed in the electroconductive thin film 4 of the device of the present example with the electron probe microanalysis (EPMA) and the X-ray photoelectron spectroscopy (XPS) and further with the Auger electron spectroscopy, it was confirmed that only carbon exists in the gap 5 and the high potential side device electrode 3 was covered by Au.

EXAMPLE 2

The processes of the Example 1 were performed until the Process d except that a substrate of soda lime glass with $SiO_2$ coated thereon was used as the substrate 1.

Process e

In order to perform the activation process, tolunitrile was introduced in the vacuum apparatus through the slow leak valve, and the pressure of $1.0\times10^{-4}$ Pa was maintained. Next, the activation processing of the device which had received the forming processing was performed with the waveform shown in FIG. 4, in which the pulse width T1 was set to 1 msec, the pulse width T1' was set to 0.1 msec, the pulse interval T2 was set to 10 msec, and the maximum voltage values were set to ±22 V, through the device electrodes 2 and 3 of the device. In this case, the voltage given to the device electrode 3 was made to be positive, and the direction of the device current If flowing from the device electrode 3 to the device electrode 2 was positive. After confirming that the device current If had been saturated after about 30 minutes, current conduction was stopped, and the slow leakage valve was closed, and then the activation processing was ended.

On the other hand, the activation process was performed to the device of a comparative example 3, which had received the same forming process as that of the device of the present example, under the conditions described above.

Process f

Successively, the stabilization process was performed. The exhaustion of the inside of the vacuum apparatus was continued while the vacuum apparatus and the electron-emitting device were heated by a heater to be kept at about 250° C. The heating with the heater was stopped after 20 hours, and the temperatures of the vacuum apparatus and the electron-emitting device were returned to the room temperature. Then, the pressure in the vacuum apparatus reached about $1\times10^{-8}$ Pa.

Process g

While the pressure in the inside of the vacuum apparatus was kept at $1\times10^{-8}$ Pa, Pt (atomic number 78) as a material having a large atomic structure factor to electron beams was obliquely evaporated from the high potential side device electrode 3 as the electron scattering surface forming film. The oblique evaporation was performed by several atomic layers by inclining the evaporation molecule beam flow coming flying from a heated evaporation source by the angle θ1 equal to 45° from the normal line of the substrate 1 after the forming processing. Although a part of Pt was also stacked on the substrate 1, the device electrodes 2 and 3, and the thin films 4*a* and 4*b* including the electron-emitting region 8, no evils owing to the stacking were produced.

On the other hand, an electron scattering surface forming film was formed in the device of the comparative example 3 by the same method as that of the device of the present example except for the angle θ1 of the oblique evaporation was set to −45°.

Successively, measurements of the electron emission characteristics were performed.

The distance H between the anode electrode 54 and the electron-emitting device was set to 4 mm, and the electric potential of 1 kV was given to the anode electrode 54 with the high voltage power supply 53. In this state, rectangular pulse voltages having peak values of 15 V were applied between the device electrodes 2 and 3 with the power supply 51, and the device currents If and the emission currents Ie of the device of the present example and the device of the comparative example 3 were measured with the ammeters 50 and 52, respectively.

In the device of the present example, the device current If was 0.41 mA, and the emission current Ie was 2.2 μA, and further the electron emission efficiency η (=Ie/If) was 0.54%. In the device of the comparative example 3, no stable emission currents Ie could measured because large leakage current flowed.

From the results, it was found that the device of the present example had the large emission current Ie and the excellent electron emission efficiency η in comparison with the device of the comparative example 3.

Moreover, the observations with an atomic force microscope (AFM) of the device of the present example and the device of the comparative example 3 which were produced in accordance with the above-mentioned processes were performed.

Moreover, as the results of the observation with the atomic force microscope (AFM) of the device of the present example produced in accordance with the above-mentioned processes like the Example 1, it was found that the shape of the present example was one including the same carbon films 6*a* and 6*b* and the electron scattering surface forming films 7*a* and 7*b* as those of the shape shown in FIGS. 1A and 1B.

Moreover, by performing the elemental analysis, of the deposit in the neighborhood of the gap 5 formed in the electroconductive thin film 4 of the device of the present example with the electron probe microanalysis (EPMA) and the X-ray photoelectron spectroscopy (XPS) and further with the Auger electron spectroscopy, it was confirmed that only carbon exists in the gap 5 and the high potential side device electrode 3 was covered by Pt.

EXAMPLE 3

An image displaying apparatus using an electron source in which electron-emitting devices were arranged in a passive matrix arrangement was produced. The manufacturing process thereof is described with reference to FIGS. 9 to 16.

<Formation of Device Electrode>

Figure 9:
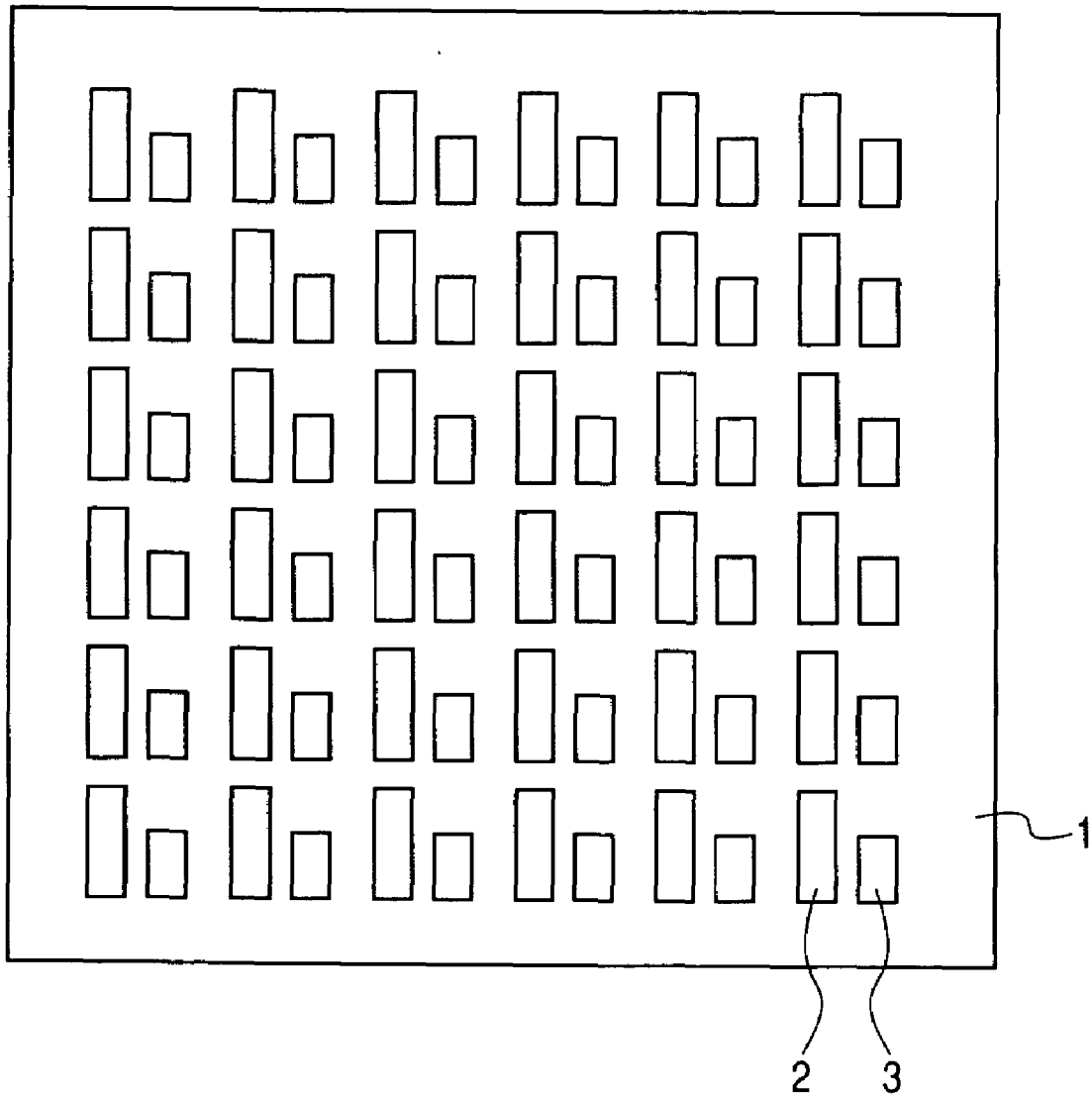
FIG. 9 is a manufacturing process chart of the electron source in an example of the present invention.

A plurality of pairs of device electrodes 2 and 3 was formed on the substrate 1 (FIG. 9).

A substrate made by coating a $SiO_2$ film to be a thickness of 100 nm as a sodium blocking layer on a sheet of glass having a thickness of 2.8 mm of PD-200 (made by Asahi Glass Co., Ltd.), which has little alkaline components, and by baking the sodium blocking layer was used as the substrate 1.

Further, a film of titanium Ti was formed to be a thickness of 5 nm on the glass substrate 1 and a film of platinum Pt was formed to be a thickness of 40 nm on the Ti film, both formed by the sputtering method as under coating layers. After that, photoresist was coated on the Pt film, and the patterning for forming the device electrodes 2 and 3 was performed by the photolithographic method composed of a series of processes of exposure, development and etching to form the device electrodes 2 and 3. In the present example, each of the intervals L of the device electrodes 2 and 3 was 10 μm, and the corresponding length W was 100 μm.

<Formation of Lower Wires>

Figure 10:
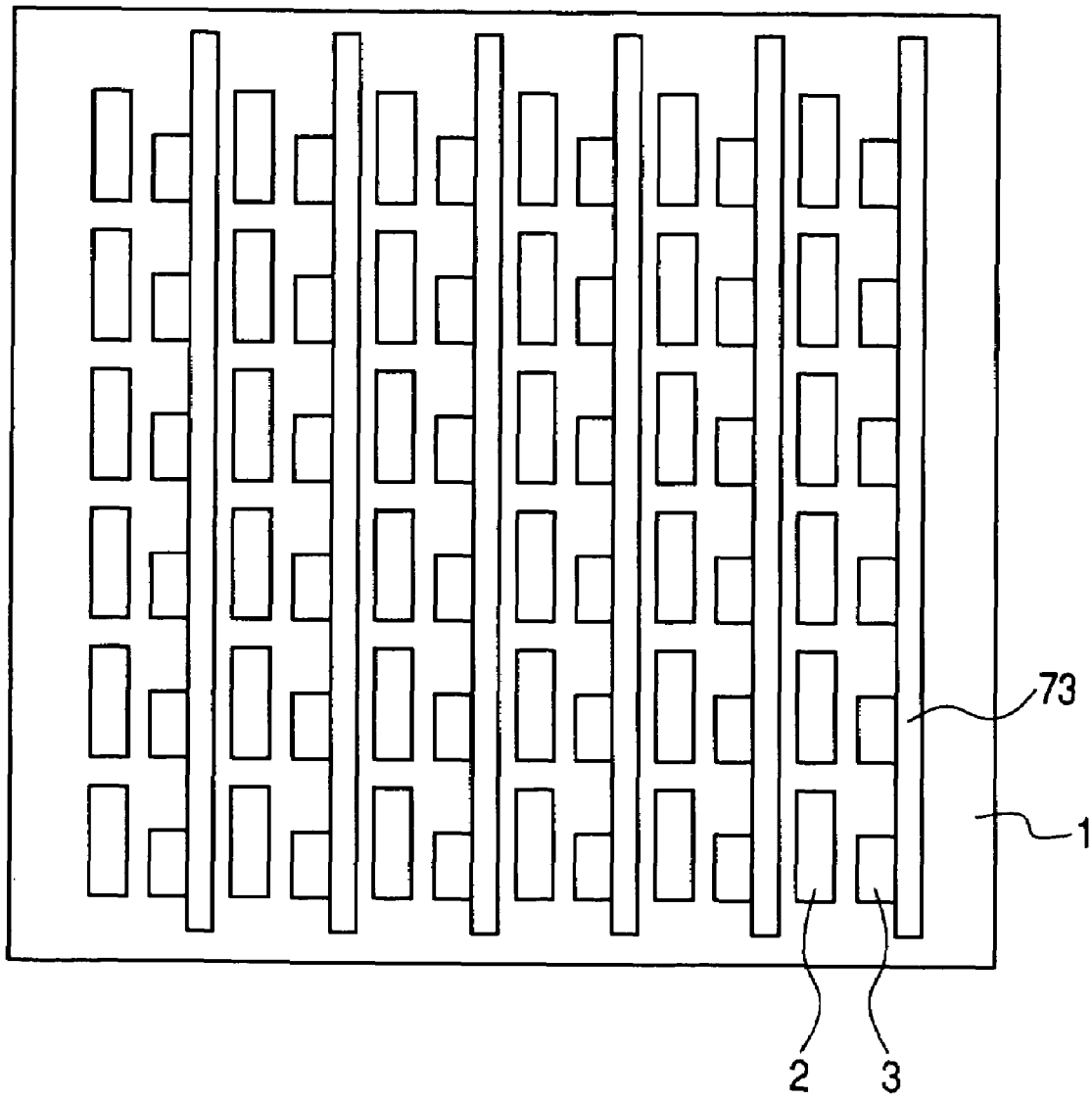
FIG. 10 is a manufacturing process chart of the electron source in the example of the present invention.

The Y-direction wires (lower wires) 73 as common wires were formed to be in a line-like pattern in order to contact with the device electrodes 3 in order to connect them each other (FIG. 10). As the material of the wires 73, a silver Ag photopaste ink was used, and the photopaste ink was printed on the substrate 1 by the screen printing method. After that, the photopase ink was dried, and was exposed to be a predetermined pattern to be developed. After that, the substrate 1 was baked at a temperature around 480° C., and wirers were formed. The thicknesses of the wires were about 10 μm and each of the line widths was 50 μm. Incidentally, the ends of the wires were formed to have large line widths in order to use as the electrodes for taking out the wires.

<Formation of Insulating Layer>

Figure 11:
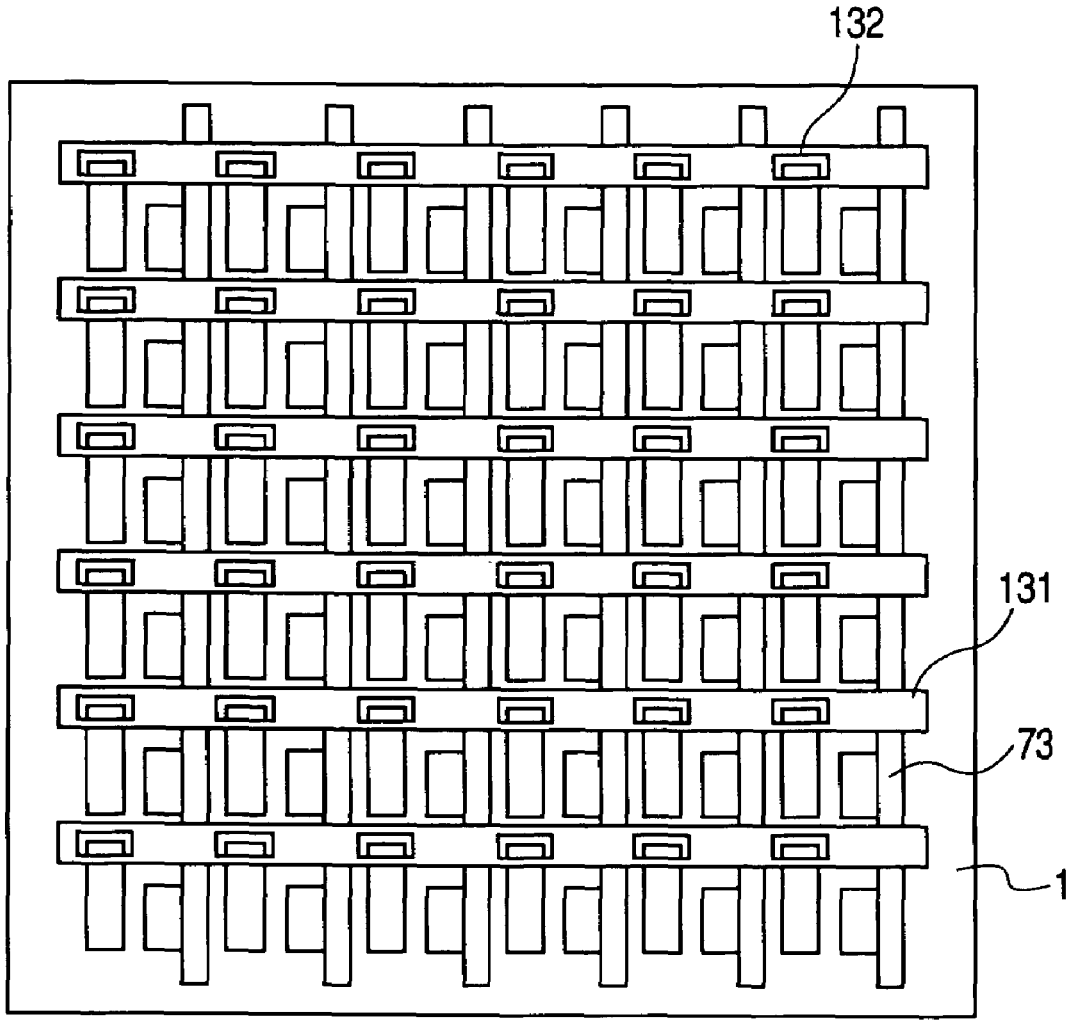
FIG. 11 is a manufacturing process chart of the electron source in the example of the present invention.

In order to insulate the upper and the lower wires, interlayer insulation layers 131 were arranged (FIG. 11). The interlayer insulation layers 131 were formed under the X-direction wires (upper wires) 72, which will be described later, to cover the intersection parts with the Y-direction wires (lower wires) 73, and contact holes 132 were opened at connection parts with the device electrodes 2 for enabling the electrical connection with the device electrodes 2.

The process of the formation of the insulating layer was as follows. After a photosensitive glass paste including PbO as its principal component was printed by the screen printing method, the glass paste was exposed and developed. The process was repeated four times, and, finally, the glass paste was baked at the temperature around 480° C. The thicknesses of the interlayer insulation layers 131 were about 30 μm in all, and each of the widths of the interlayer insulation layers 131 were 150 μm.

<Formation of Upper Wires>

Figure 12:
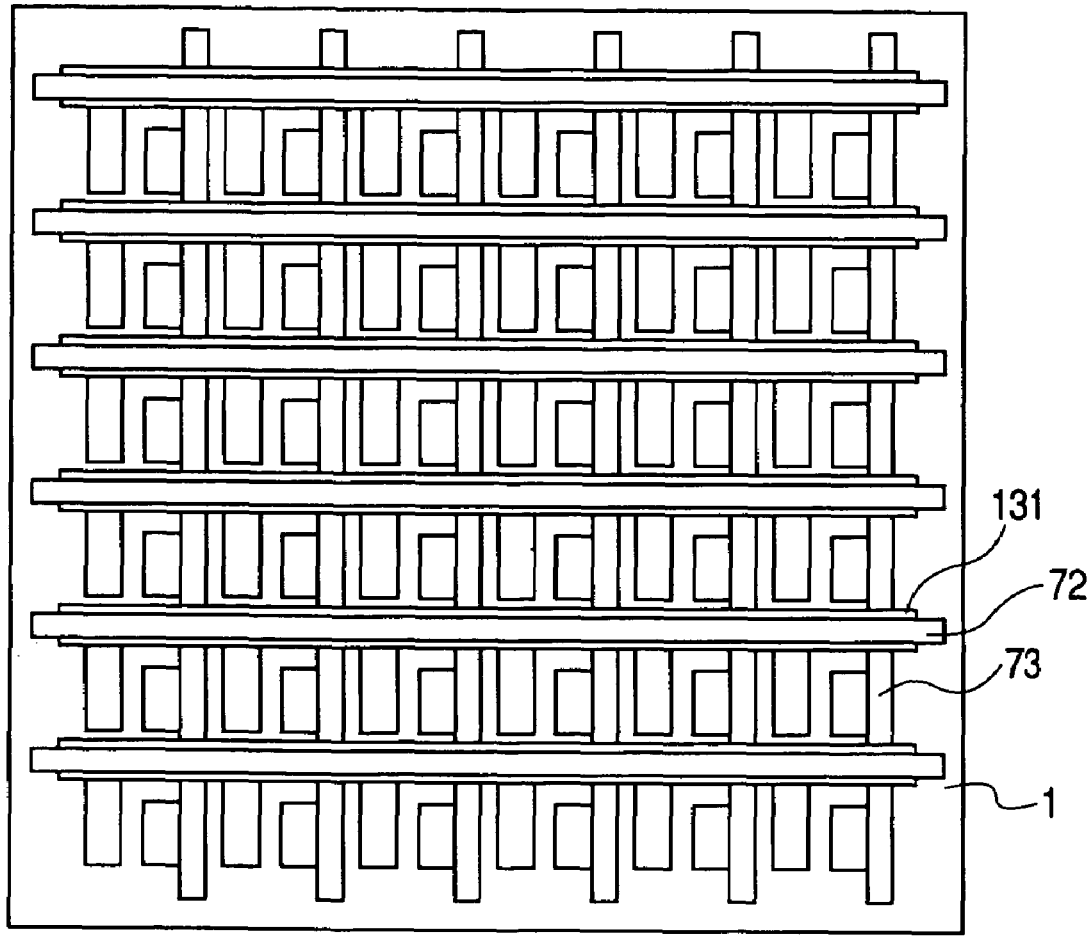
FIG. 12 is a manufacturing process chart of the electron source in the example of the present invention.

A Ag paste ink was printed on the interlayer insulation layers 131 formed in the previous process by the screen printing method, and was dried after that. The same process was performed on the printed Ag paste again as two-times coating. After that, the Ag paste was baked at a temperature around 480° C., and the X-direction wires (upper wires) 72 were formed (FIG. 12). The X-direction wires 72 intersected with the Y-direction wires (lower wires) 73 with the insulated layers 131 put between them, and the X-direction wires 72 were also contacted with the device electrodes 2 at the contact hole 132 portions. By the X-direction wires 72 the device electrodes 2 are connected to one another, and the X-direction wires 72 operate as scanning electrodes after being made to be a panel. The thicknesses of the X-direction wires 72 are about 15 μm. Extraction wires to an external drive circuit were also formed by the same method as the one described above.

Although not shown, extraction terminals to the external drive circuit were also formed by the same method as the one described above.

An electron source base including the XY matrix wiring was formed in this way.

<Formation of Electroconductive Thin Film>

Figure 13:
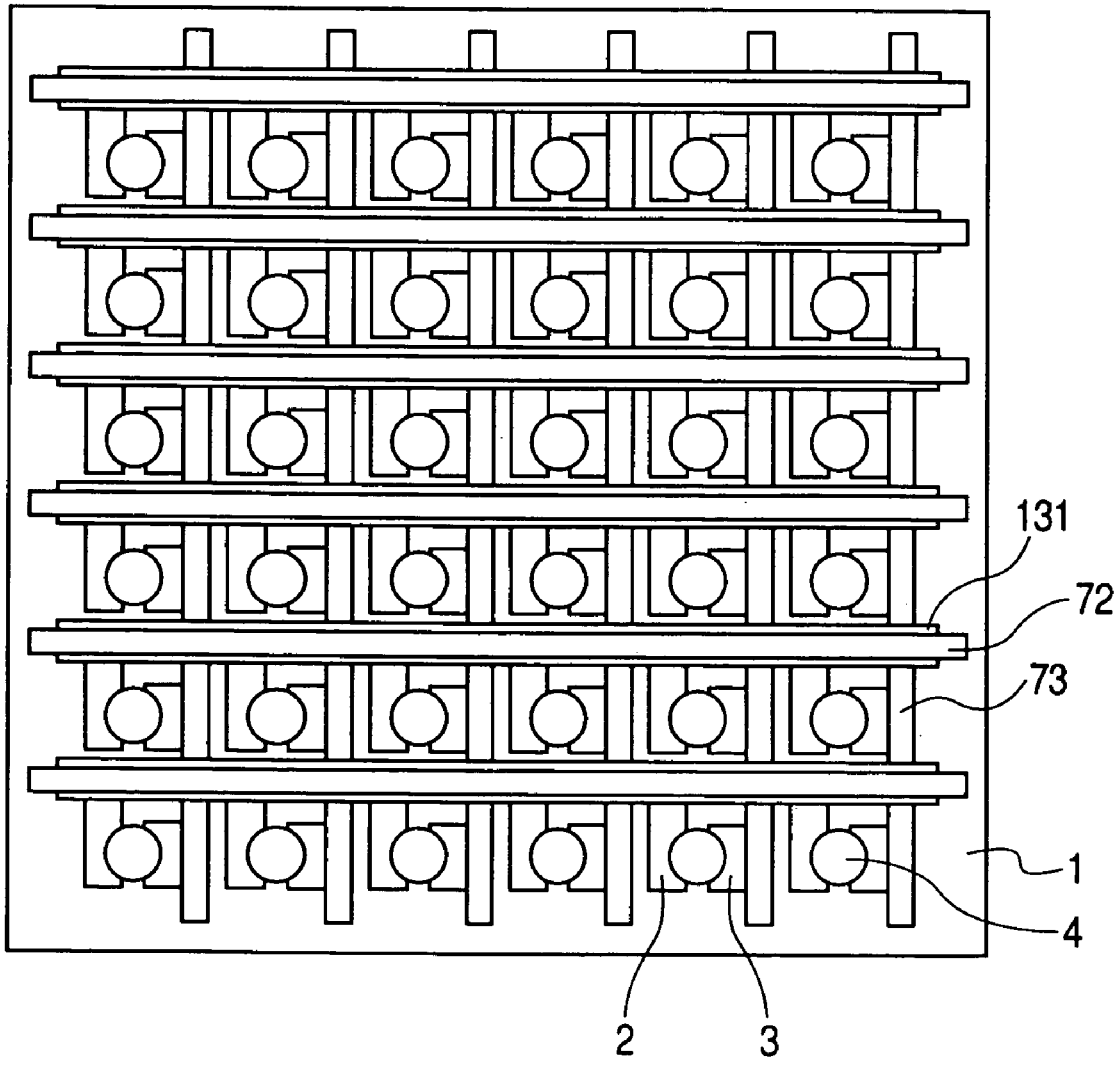
FIG. 13 is a manufacturing process chart of the electron source in the example of the present invention.
Figure 14A:
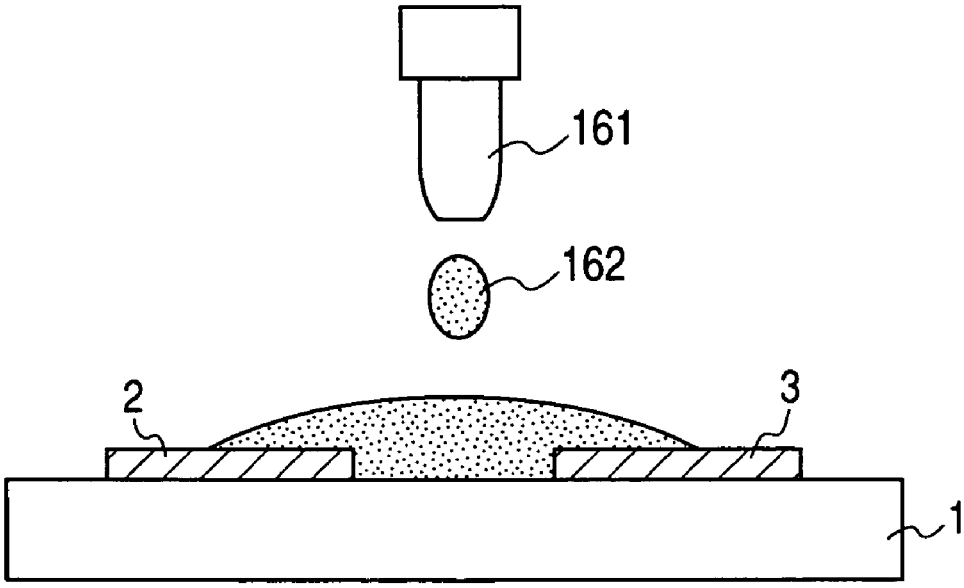
FIGS. 14A and 14B are schematic views showing formation processes of an electroconductive thin film of the electron source of the example of the present invention.
Figure 14B:
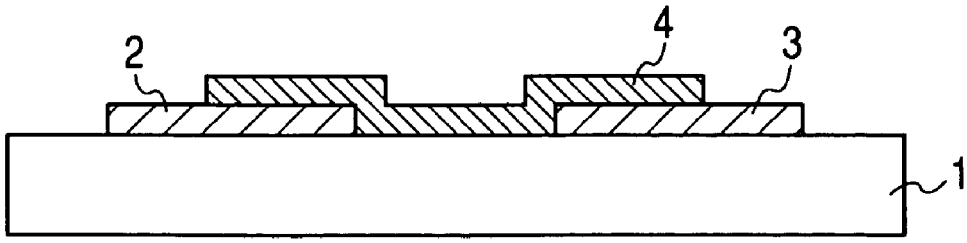

After fully cleaning the electron source base, the surface thereof was processed with the solution containing a water repellency agent to make the surface thereof have a hydrophobic property. The formation of the surface to have the hydrophobic property aims that the aqueous solution for the formation of the electroconductive thin films 4 which are applied after this process is disposed with a suitable spread on the device electrodes. After that, the electroconductive thin films 4 were formed by the ink jet coating method between the device electrodes 2 and 3 (FIG. 13). A schematic diagram of the process is shown in FIGS. 14A and 14B. In FIGS. 14A and 14B, a reference numeral 161 denotes droplet giving means, and a reference numeral 162 denotes a droplet.

In an actual process, in order to compensate a planer dispersion of the respective device electrodes 2 and 3 on the substrate 1, the shifts of arrangement of the pattern is observed at several positions on the substrate 1, and the shift quantities of points between observation points are linearly approximated to perform positional interpolation. Then coating is performed. Thus, the positional shifts of all pixels were tried to be removed, and precise coating to the corresponding positions was tried. In the present example, for obtaining palladium films as the electroconductive films 4, first, 0.15 mass percentages of palladium proline complex was dissolved in the aqueous solution which consisted of 85 of water to 15 of isopropyl alcohol (IPA), and an organic palladium-containing solution was obtained. Incidentally, some additive agents were added. Using an ink jet injection apparatus using a piezo-electric device as the droplet giving means 161, the droplets 162 of the solution were adjusted so that the diameters of dots might be set to 60 μm, and the droplets 162 were given between the device electrodes 2 and 3. After that, in the air, the heating baking processing of the substrate 1 was performed at 350° C. for 10 minutes, and the droplets 162 were made to palladium oxide (PdO). Films having the diameters of the dots being about 60 μm and the film thicknesses being 10 nm at the maximum were obtained.

By the process described above, the films of palladium oxide PdO were formed in the electroconductive thin film portions. The resistance values of the electroconductive thin films 4 of the electron source base were within a range from 3500 Ω to 4500 Ω.

Next, an image displaying apparatus was produced. The production procedure is described below.

Figure 16:
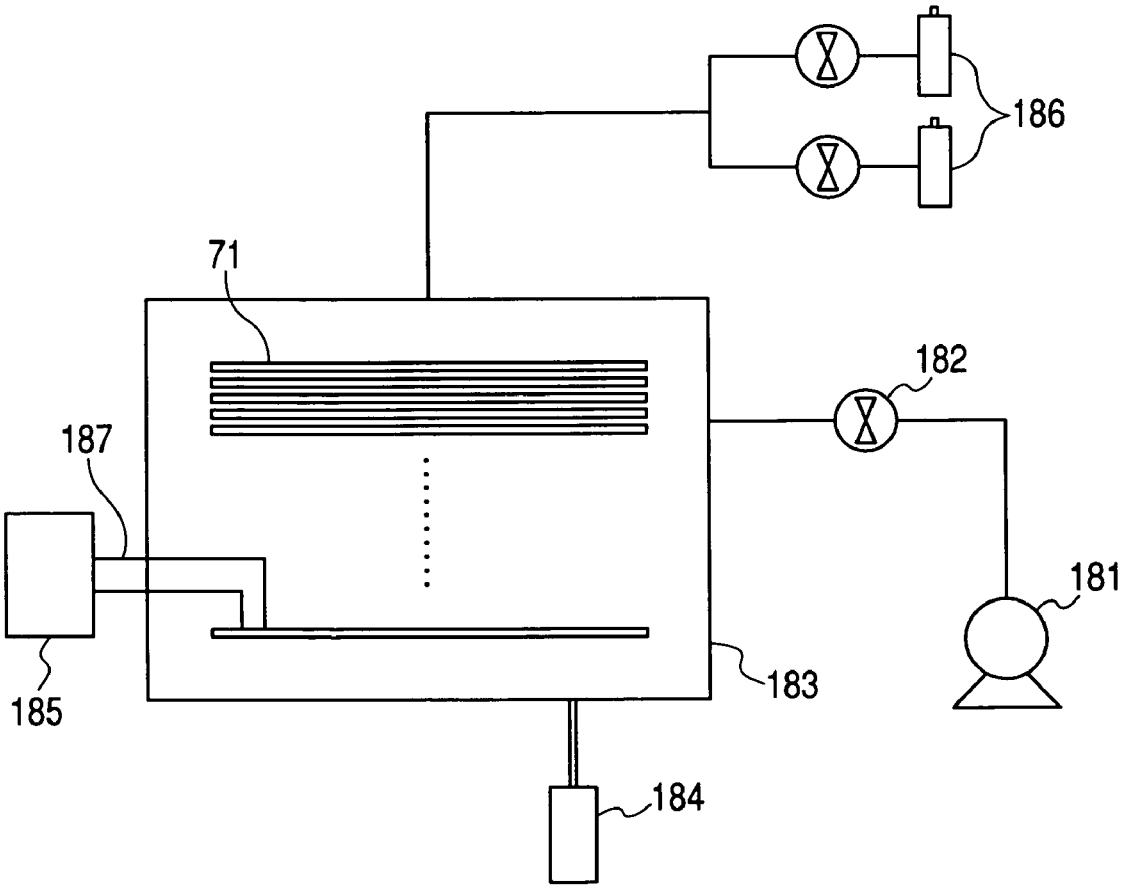
FIG. 16 is a schematic diagram showing a reduction process of the electroconductive thin film of the electron source of the example of the present invention.

The reduction process of the electroconductive thin films is described with reference to FIG. 16. In FIG. 16, reference numeral 181 denotes an exhaust pump, a reference numeral 182 denotes an exhaust valve, a reference numeral 183 denotes a vacuum chamber, a reference-numeral 184 denotes a vacuum gauge, a reference numeral 185 denotes an ammeter, a reference numeral 186 denotes gas bombs, and a reference numeral 187 denotes a wire.

In FIG. 16, first, the electron source base 71 which had not received the forming was put in the vacuum chamber 183, and the pressure in the vacuum chamber 183 was set to $1.3\times10^{-3}$ Pa or less. After that, as a reducing gas, a mixed gas of 98% of $N_2$ and 2% of $H_2$ was introduced into the vacuum chamber 183, and the pressure therein was set to $5\times10^{-2}$ Pa. While the electron source base 71 was held for 30 minutes in that state, the resistance values of the electroconductive thin films of the electron source were monitored with the ammeter 185. After that, each electron source was reduced, and the resistance values became within a range from 500 Ω to 2000 Ω. After that, the reducing gas was exhausted, and the electron source base 71 was taken out from the vacuum chamber 183.

Figure 15:
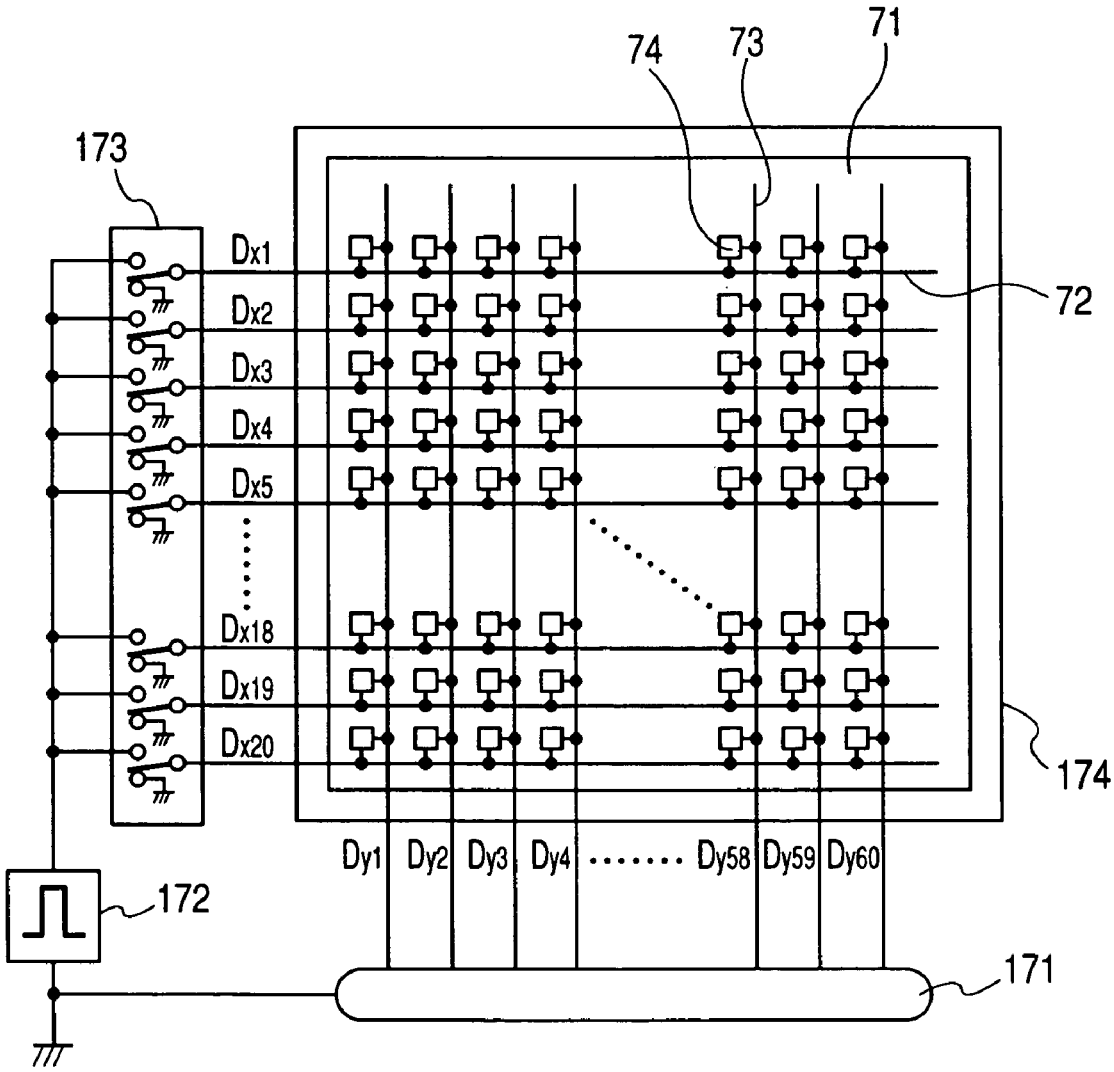
FIG. 15 is a wiring diagram in forming processing and activation processing of the electron source in the example of the present invention.

Next, the electron source base 71 was put in a vacuum chamber other than the above-mentioned vacuum chamber for the forming processing, and the pressure was set to $1.3\times10^{-3}$ Pa. The wiring for applying pulse voltages to each electron-emitting device for forming processing is schematically shown in FIG. 15. In FIG. 15, a reference numeral 171 denotes a common electrode, a reference numeral 172 denotes a pulse generator, a reference numeral 173 denotes a control switching circuit, and a reference numeral 174 denotes a vacuum apparatus.

In FIG. 15, by connecting the external terminals Dy1 to Dyn of the Y-direction wires 73 to the common electrode 171, the Y-direction wires 73 are commonly connected, and Y-direction wires 73 are connected to the terminal on the side of the ground of the pulse generator 172. The X-direction wires 72 are connected to the control switching circuit 173 through the external terminals Dx1 to Dxm (the case of m=20 and n=60 is shown in FIG. 15). The control switching circuit 173 connects each terminal to either the pulse generator 172 or the ground, and FIG. 15 shows the function thereof schematically.

The forming processing was performed by the method of selecting one row of the device rows in the X directions with the switching circuit 173, switching the device row to be selected every application of one pulse, and processing all of the device rows simultaneously. The waveforms of the applied pulse voltages are the triangular wave pulses the peak values of which gradually increase as shown in FIG. 3B. The pulse width T1 was set to 1 msec, and the pulse interval T2 was set to 10 msec. Moreover, a rectangular wave pulse having peak value of 0.1 V was inserted between the above-mentioned pulses, and the resistance value of the device was measured.

Successively, activation processing was performed. The activation processing was carried out by repeatedly applying pulse voltages to the device electrodes through the XY direction wiring from the exterior. At this process, tolunitrile was used as carbon or the like, and the tolunitrile was introduced into the vacuum space to maintain the pressure of $1.3\times10^{-4}$ Pa. The activation processing was performed under the setting of the waveform shown in FIG. 4 in which the pulse width T1 on the positive side was set to 1 msec, the pulse width T1' on the negative side was set to 0.1 msec, the pulse interval T2 was set to 10 msec, and the maximum voltage values were set to ±22 V. In this case, the electrode 3 sides were made positive. At the time point when the device current If had reached almost saturation after about 60 minutes from the start, current conduction was stopped, and the introduction of the tolunitrile was stopped. Then, the activation processing was ended.

Next, the electron scattering surface forming film was formed. While the pressure in the vacuum apparatus was kept to $1\times10^{-8}$ Pa, the oblique evaporation of Pt (atomic number 78) as a material having a large atomic structure factor to electron beams was carried out from the electrode 3 sides as the electron scattering surface forming films. Each of the electron scattering surface forming films was formed by the evaporation by several atomic layers by inclining the evaporation molecule beam flow coming flying from a heated evaporation source by an angle θ1=45° from the normal line of the substrate 1 after the forming processing.

The processing was performed to all the electron source devices.

Next, after fixing the electron source base 71 on the rear plate 81, the faceplate 86 (composed of the glass substrate 83, the fluorescent film 84, which is the image forming member, and the metal-back 85. The fluorescent film 84 and the metal-back 85 were formed on the inner surface of the glass substrate 83) was disposed at a position above the substrate 71 by 5 mm with the supporting frame 82 put between the faceplate 86 and the substrate 71. Then frit glass was applied to the joining part of the faceplate 86, the supporting frame 82 and the rear plate 81. The seal bonding was performed by baking the panel in the air at 400° C. for ten minutes. Incidentally, the fixation of the substrate 71 to the rear plate 81 was also performed with the frit glass.

In order to realize a color display, the phosphor in the stripe form (see FIG. 8A) was used as the fluorescent film 84, which is an image forming member. The black stripe which consisted of a black electroconductive material 91 was formed first, and each color phosphor 92 was coated at the gap parts of the black electroconductive material 91 by the slurry method. Thereby, the fluorescent film 84 was produced. As the black electroconductive material 91, a material including graphite as its principal component, which was usually frequently used, was used.

Moreover, the metal-back 85 was formed on the inner side of the fluorescent film 84. The metal-back 85 was produced by performing smoothing processing (usually called as filming) of the inner side surface of the fluorescent film 84 after the production of the fluorescent film 84, and then by evaporating A1 thereon in the vacuum.

At the time of performing the above-mentioned seal bonding, it is needed in a color display to make each color phosphor 92 correspond to the electron-emitting devices 74, and accordingly sufficient alignment was performed.

The inside of the vacuum chamber (envelope 88) formed as mentioned above was exhausted while heating the vacuum chamber. When the pressure in the vacuum chamber became $1.3\times10^{-4}$ Pa or less, the exhaust pipe (not shown) was heated with a gas burner to be welded. Thereby, the vacuum chamber was sealed. Furthermore, getter processing was performed by high frequency heating in order to maintain the pressure in the vacuum chamber to be low.

In the image displaying apparatus completed as mentioned above, a desired electron-emitting device was selected through the X-direction wires and the Y-direction wires. When a pulse voltage of +20 V was applied on the electrode 3 side and a voltage of 8 kV was applied to the metal back 85 through the high-voltage terminal Hv, a bright good image was able to be formed over a long time.

This application claims priority from Japanese Patent Application No. 2004-125255 filed on Apr. 21, 2004, which is hereby incorporated by reference herein.

What is claimed is:

1. An electron-emitting device equipped with a pair of first electroconductive members arranged on a substrate with an interval between them, wherein the interval becomes narrower at an upper position distant from a surface of said substrate than at a position on the surface, and a peak of one of said pair of the first electroconductive members is higher than a peak of the other of said pair of the first electroconductive members, and further an electron scattering surface forming film including an element having an atomic number larger than those of elements constituting said first electroconductive members as a principal component is provided on a surface of said one of the first electroconductive members.

2. An electron-emitting device according to claim 1, wherein said pair of the first electroconductive members are electroconductive members including carbon as the principal components.

3. An electron-emitting device according to claim 2, wherein said electron scattering surface forming film is a film including an element having an atomic number larger than that of the carbon as the principal component.

4. An electron-emitting device according to claim 2, wherein said electron scattering surface forming film is a film including a metal having an atomic number larger than that of the carbon as the principal component.

5. An electron-emitting device according to claim 1, further comprising a pair of second electroconductive members disposed on said substrate, said second electroconductive members connected with said first electroconductive members, respectively.

6. An electron-emitting device according to claim 1, further comprising means for applying high electric potential to said one of the first electroconductive members and low electric potential to the other of the first electroconductive members, respectively.

7. An electron source comprising a plurality of said electron-emitting devices according to claim 1, said electron emitting devices arranged on said substrate.

8. An image displaying apparatus, comprising:

an electron source including a plurality of said electron-emitting devices according to claim 1 arranged on a substrate; and a phosphor member emitting light by irradiation of electrons emitted from said electron-emitting devices.

9. A method for manufacturing an electron-emitting device, comprising the steps of:

forming a pair of first electroconductive members on a substrate with a first interval becoming narrower at an upper position distant from a surface of said substrate than at a position on the surface, each of said pair of the first electroconductive members having a peak, one of the peaks being higher than the other; and flying evaporated molecules of a metal having an atomic number larger than those of elements constituting the first electroconductive members or evaporated molecules of a compound of the metal from a side of said one of the first electroconductive members to a side of the other of the first electroconductive members to deposit said evaporated molecules on said one of the first electroconductive members.

10. A method for manufacturing an electron-emitting device according to claim 9, wherein said pair of the first electroconductive members are electroconductive members including carbon as principal components.

11. A method for manufacturing an electron-emitting device according to claim 10, wherein said step of forming said pair of the first electroconductive members on said substrate includes the steps of:

forming a pair of second electroconductive members having a second interval between them on said substrate; and applying bipolar voltage pulses having waveforms different in each polarity between said pair of the second electroconductive members in an atmosphere including carbon-compound gas.

12. A method for manufacturing an electron-emitting device according to claim 11, wherein said voltage pulses have pulse widths different in each of the polarities.

13. A method for manufacturing an electron source equipped with a plurality of electron-emitting devices on a substrate, wherein said electron-emitting devices are manufactured by the method according to claim 9.

14. A method for manufacturing an image displaying apparatus including an electron source equipped with a plurality of electron-emitting devices on a substrate and a phosphor member emitting light by irradiation of electrons emitted from said electron-emitting devices, wherein said electron-emitting devices are manufactured by a method according to claim 9.

* * * * *

UNITED STATES PATENT AND TRADEMARK OFFICE

CERTIFICATE OF CORRECTION

PATENT NO. : 7,312,561 B2
APPLICATION NO. : 11/106584
DATED : December 25, 2007
INVENTOR(S) : Takuto Moriguchi et al.

It is certified that error appears in the above-identified patent and that said Letters Patent is hereby corrected as shown below:

COLUMN 1

Line 57, “is important” should read --goes--; and
Line 58, “is” should read --are--.

COLUMN 2

Line 24, “above is” should read --above,--.

COLUMN 3

Line 11, “view” should read --views--;
Line 37, “he” should read --the--; and
Line 56, “above is” should read --above,--.

COLUMN 5

Line 10, “consists” should read --consisting--; and
Line 45, “conductor” should read --conductors--.

COLUMN 12

Line 29, “consists” should read --consisting--.

COLUMN 13

Line 24, “an” should read --a--.

COLUMN 14

Line 24, “as” should be deleted.

COLUMN 15

Line 9, “were” should read --was--.

COLUMN 16

Line 1, “had” should read --had been--.

UNITED STATES PATENT AND TRADEMARK OFFICE

CERTIFICATE OF CORRECTION

PATENT NO. : 7,312,561 B2
APPLICATION NO. : 11/106584
DATED : December 25, 2007
INVENTOR(S) : Takuto Moriguchi et al.

It is certified that error appears in the above-identified patent and that said Letters Patent is hereby corrected as shown below:

COLUMN 17

Line 28, “an” should read --a--.

COLUMN 19

Line 31, “under coating” should read --undercoating--.

COLUMN 20

Line 8, “A” should read --An--;
Line 46, “planer” should read --planar--; and
Line 48, “is” should read --are--.

COLUMN 23

Line 31, “components.” should read --component.--; and
Line 52, “electron” (second occurrence) should read --electron- --.

COLUMN 24

Line 3, “claim 1” should read --claim 1,--; and
Line 26, “principal components.” should read --the principal component.--.

Signed and Sealed this

Fifth Day of August, 2008

JON W. DUDAS
*Director of the United States Patent and Trademark Office*